United States Patent [19]

Albright et al.

[11] 3,988,236

[45] Oct. 26, 1976

[54] PROCESS FOR THE CONTINUOUS HYDROCARBONIZATION OF COAL

[75] Inventors: Charles William Albright, South Charleston; Hubert Greenidge Davis, Charleston, both of W. Va.

[73] Assignee: Union Carbide Corporation, New York, N.Y.

[22] Filed: Dec. 27, 1974

[21] Appl. No.: 536,850

Related U.S. Application Data

[63] Continuation-in-part of Ser. No. 830,839, June 5, 1969, which is a continuation-in-part of Ser. No. 376,415, June 19, 1964, abandoned.

[52] U.S. Cl. ..... 208/8; 48/210

[51] Int. Cl.[2] ..... C10G 1/06

[58] Field of Search ..... 208/8; 48/197 R, 210

[56] References Cited

UNITED STATES PATENTS

| | | | |
|---|---|---|---|
| 2,634,286 | 4/1953 | Elliott et al. | 208/8 |
| 2,657,124 | 10/1953 | Gaucher | 208/8 |
| 2,709,675 | 5/1955 | Phinney | 202/23 |
| 3,152,063 | 10/1964 | Schroeder et al. | 208/10 |
| 3,231,486 | 1/1966 | Perry et al. | 208/8 |
| 3,347,647 | 10/1967 | Feldkirchner et al. | 48/197 R |
| 3,375,175 | 3/1968 | Eddinger et al. | 48/210 |
| 3,617,465 | 11/1971 | Wolk et al. | 208/8 |
| 3,755,137 | 8/1973 | Schuman | 208/10 |
| 3,823,084 | 7/1974 | Schroeder | 208/10 |

*Primary Examiner*—Delbert E. Gantz
*Assistant Examiner*—James W. Hellwege
*Attorney, Agent, or Firm*—Israel Blum

[57] ABSTRACT

A continuous, hydrocarbonization process wherein a dense-phase flow of coal particles is indirectly preheated in the absence of oxygen to a temperature below the temperature at which the coal particles undergo plastic transformation, introduced into the bottom of a vertical fluid-bed reaction zone at a high velocity in a vertically upwards direction and reacted with hydrogen to yield char, liquid and gaseous products. The hydrocarbonization reaction is conducted at a temperature of 480° C–600° C, a hydrogen partial pressure of from about 100 p.s.i. to about 1200 p.s.i. and an average solids residence time of 1 to about 30 minutes, preferably about 5 to about 60 minutes. A high velocity enables the coal particles entering the reaction zone to rapidly and uniformly distribute themselves at their preheated temperature within a matrix of nonagglomerating particles within the reaction zone, thus preventing agglomeration of the coal particles in the fluid-bed reaction zone.

20 Claims, 2 Drawing Figures

PROCESS FOR THE CONTINUOUS HYDROCARBONIZATION OF COAL

RELATED APPLICATIONS

Figure 1:
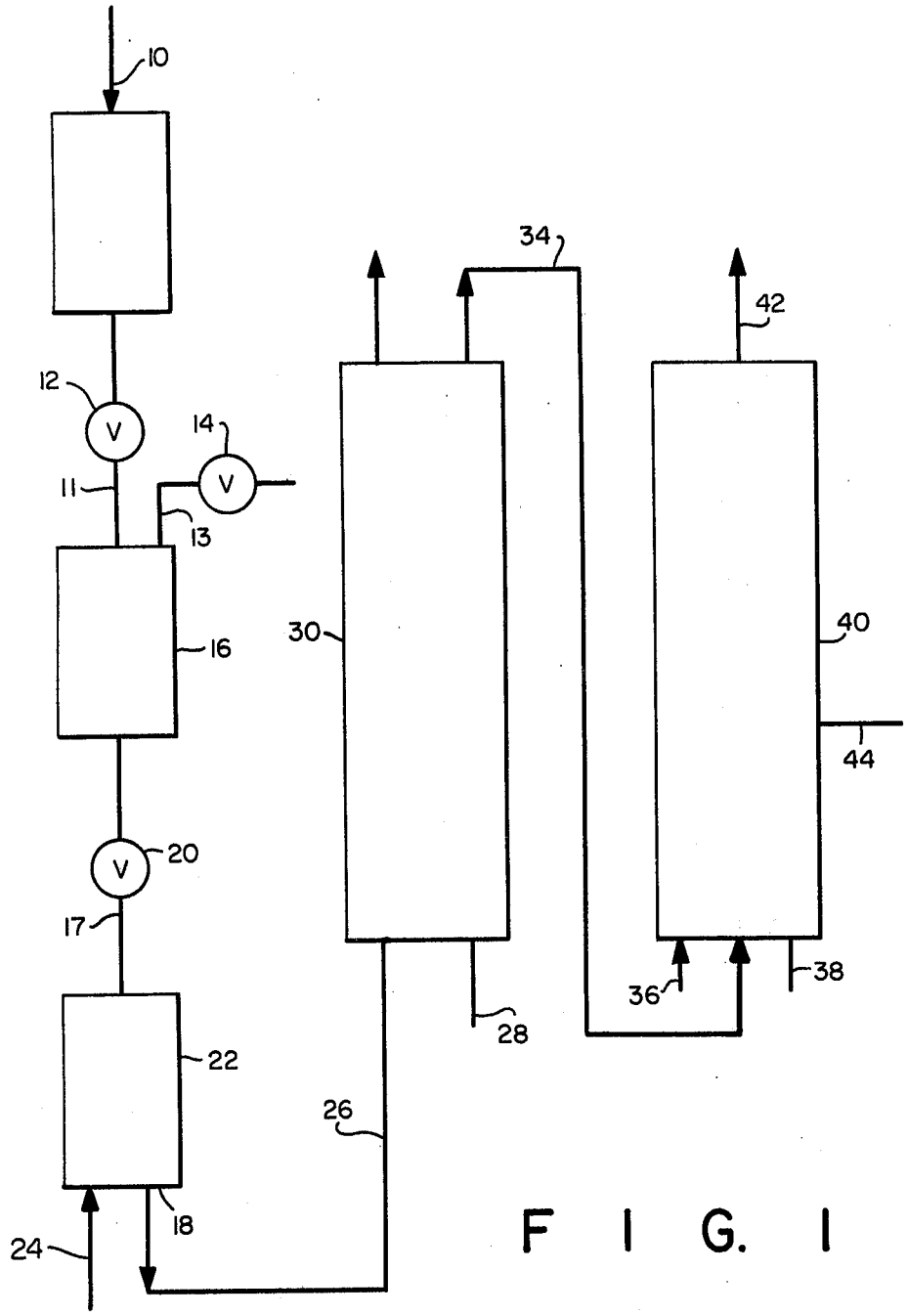

This application is a continuation-in-part application of U.S. Pat. application Ser. No. 830,839 filed June 5, 1969, which in turn is a continuation-in-part application of U.S. Pat. application Ser. No. 376,415 filed June 19, 1964, now abandoned.

BACKGROUND OF THE INVENTION

1. Field of the Invention

This invention relates generally to a process for the production of phenolic compounds from coal. In another aspect, this invention relates to a process for preparing char and gaseous liquid fuel products from coal. More particularly, this invention concerns a method of reacting coal with hydrogen in a manner such that the ratio of phenolic compounds produced to hydrogen consumed is maximized. More particularly, this invention also relates to a continuous hydrocarbonization process employing a fluid-bed reaction zone for converting coal to char and gaseous and liquid fuel products.

2. Description of the Prior Art

Increasing energy needs have focused attention on solid fossil fuels due to their availability in the United States in a relatively abundant supply and their potential value when converted into more useful forms of energy and feedstock. Coal is known to be a potential valuable source of chemical compounds as well, and considerable effort has been expended in an attempt to develop a process for the efficient production of such chemicals and such fuel products. The first processes involved the carbonization of coal in an inert atmosphere to produce only about 5 to 15 weight percent generally about 10 to 15 weight percent based on the coal charged, of liquid product and about 70 to 75 weight percent of a solid char. Since the products were generally suitable only as fuels, these processes were not commercially feasible in this country. The low yield and poor quality of products rendered them commercially unattractive. The worth of the unit heating value of the solid char product even with all the gas and liquid product was less than that of the coal charged.

In an effort to convert the bulk of the coal to a liquid product, the hydrogenolysis processes were developed. In these processes a recyclable "pasting oil" was necessary to initially dissolve or slurry the raw coal; the slurry of coal and usually a catalyst in oil was heated in the presence of hydrogen gas at 450° C to 550° C and about 2000 to 10,000 p.s.i.g., generally 5000 to 10,000 p.s.i.g.; and up to 20 to 30 percent of the finely-divided unreacted coal and ash had to be filtered off or otherwise removed from the heavy, viscous primary oil product. Although these processes were successful in that the amount of liquid products were substantially increased, they were not commercially acceptable because the investment, the operating costs and in particular the hydrogen requirements were too high in comparison with the value of the products obtained. They are considered only in special economic conditions where alternate energy sources such as crude oil are expensive or unavailable.

More recently, dry "hydrocarbonization" processes were developed wherein coal was heated with hydrogen gas. However, these processes were generally batch-type processes and, because they were conducted at greatly elevated temperatures and pressures, resulted in the production of hydrocarbon gases and liquids useful mainly as fuels. Moreover, these batch processes were not convertible to operable continuous processes in any obvious manner. Greatly elevated temperatures and pressures at which these processes functioned also make them difficult to operate and impractical. It was shown in U.S. Pat. No. 3,231,486 that a sub-bituminous coal, Elkol coal, may be carbonized under mild operating conditions in the presence of hydrogen in a fluid-bed. Other processes were directed toward total gasification rather than the production of both gas and oil.

Total gasification requires large consumption of hydrogen as well as difficult and costly operating conditions. For example, using the crude stoichimetric equation, $CH_8$ (coal) + 1.6$H_2$ $CH_4$, as a basis for roughly calculating hydrogen consumption, total gasification of 100 pounds of idealized coal ($CH_{.8}$) at 100 percent efficiency would require 25 pounds of hydrogen. This is a hydrogen consumption of about 25% of the coal by weight. The hydrogen could be supplied, for example, by steam gasification of an additional 57 pounds of idealized coal ($CH_{.8}$), and the consumption of an additional large quantity of coal, depending on the process, as fuel.

The object of this invention is an improved process for the hydrocarbonization of coal wherein the primary products comprise a mixture of both gaseous and liquid products and wherein the process consumes modest amounts of hydrogen amounting to about 1 to about 5 weight percent of the coal charged. By the term hydrocarbonization as employed throughout the specification, is meant a pyrolysis or carbonization in a hydrogen-rich atmosphere under such conditions that significant reaction of hydrogen with coal and/or partially reacted coal and/or volatile reaction products of coal occurs.

The hydrocarbonization process of this invention provides improved control over product yield, quality and distribution. Although product distribution between gas, liquid and solid carbonaceous residue is to a certain extent a function of the nature of the particular coal charged, the pattern may be altered considerably by variation in reaction conditions such as pressure, temperature, residence time and type of recycle operation used. Moreover, regardless of the yield and/or distribution, as a result of hydrocarbonization, the end products are also more stable than those obtained from the same coal by pyrolysis.

The process of this invention is an improved hydrocarbonization process wherein the primary product, amounting up to about 5 to 10 weight percent of the coal charged, consists of valuable phenolic compounds. In addition, the ratio of phenolic compounds and other liquid products to the amount of hydrogen consumed is considerably higher than that of the prior art process, resulting, for the first time, in an economically attractive method for obtaining chemicals, particularly phenolic compounds from coal. Moreover, when liquid and fuel products are desired, the hydrocarbonization process of this invention also provides a ratio of liquid and gaseous fuel products compared to the amount of hydrogen consumed that is considerably higher than that of prior art processes, resulting in an economically attractive process for converting coal to liquid and gaseous fuel products.

In addition, the amount of char is reduced from 70 to 75 percent to less than 60 percent, and often as low as 30 percent of the coal charged. More significantly, the improved control over product yield, quality and distribution in the hydrocarbonization process of this invention makes it particularly adaptable and integratable into an essentially internally balanced process. Conversion to liquid and gas products may be controlled to produce an amount of char lust sufficient to satisfy other supportive needs, such as hydrogen production, plant fuel and miscellaneous high-level, heat energy requirements.

The process of this invention, in its broadest aspect, comprises continuously feeding particulate coal and a hydrogen-containing, oxygen-free gas to a hydrocarbonization zone under relatively mild conditions of temperature and pressure to convert said coal to a vapor and a solid char, and continuously withdrawing the vapors and char from the hydrocarbonization zone. In this process, there is a continuous movement of the solids in the fluidized bed throughout the hydrocarbonization zone, with the composition of solids in the bed approximately that of the char.

The process of this invention, broadly stated, also comprises continuously fluidizing a dense phase flow of coal particles in a finely-divided form; preheating the fluidized particles in an essentially oxygen-free atmosphere to a temperature below the range where surface plasticity, or stickiness is developed; introducing the preheated particles into the bottom of a hydrocarbonization zone at a high velocity; fluidizing the coal, partially reacted coal and char particles as a fluid-bed in the zone with a hydrogen containing, oxygen-free gas; reacting the coal particles with hydrogen under relatively mild conditions of temperature and pressure to convert the coal particles to a vapor and a solid char; and continuously withdrawing the vapors and char from the hydrocarbonization zone. In this process as well, there is a continuous movement of the solids in the fluidized bed throughout the hydrocarbonization zone, with the composition of the solids in the bed approximately that of the char.

The reaction products are hydrocarbon gases, mostly saturated, non-hydrocarbon gases, principally carbon monoxide and carbon dioxide, light hydrocarbon liquids, tar, water and char. The tar reaction products contain high concentrations of phenolic compounds, aromatic hydrocarbons and precursors, and gasoline components or precursors. When desirable, the tar reaction products are readily convertible to hyrocarbon fuel products by methods well know to those skilled in the art, such as hydrotreating. Tar yields in this hydrocarbonization process are at least approximately double those of carbonization in the absence of hydrogen. Furthermore, the tar yields may be controlled over a range by varying reaction conditions such as time, pressure and temperature.

It has been discovered that exposure of coal to oxidizing conditions during the various phases of operation reduces tar yields upon hydrocarbonization of the coal. In order to maximize the production of phenolic materials from coal, non-oxidizing conditions or substantially non-oxidizing conditions must be employed in all phases of the operation such as during the mining, shipping, storage, preparation and reaction of the coal employed especially where the lowest rank coals are used such as sub-bituminious coals particularly those of the non-agglomerating type especially types such as sub-bituminous C and lower ranked coals such as lignitic coals. In general, therefore, substantially non-oxidizing conditions should be employed in mining, shipping, storage, preparation and in the process itself when it is desirable to maximize tar yields. On the other hand, it is recognized that a limiting preoxidation may be beneficial to reducing the agglomerating tendency of certain other coals such as, for example, agglomerating, high-volative A, bituminous coals. In this case, a trade-off exists between loss of desirable products and reduced agglomeration.

Coal has been classified according to rank as noted in the following table, Table A.

Table A

Classification of Coals by Rank.[a]
(Legend: F.C. = fixed carbon; V.M. = volatile matter; B.t.u. = British thermal units)

| Class | Group | Limits of fixed carbon or B.t.u., ash free basis |
|---|---|---|
| I. Anthracite | 1. Meta-anthracite | Dry F.C., 98% or more (dry C.M., 2% or less) |
| | 2. Anthracite | Dry F.C., 92% or more and less than 98% (dry V.M., 8% or less and more than 2%) |
| | 3. Semianthracite[b] | Dry F.C., 86% or more and less than 92% (dry V.M., 14% or less and more than 8%) |
| II. Bituminous[d] | 1. Low-volatile bituminous coal | Dry F.C., 78% or more and less than 86% (dry V.M., 22% or less and more than 14%) |
| | 2. Medium-volative bituminous coal | Dry F.C., 69% or more and less than 78% (dry V.M., 31% or less and more than 22%) |
| | 3. High-volatile A bituminous coal | Dry F.C., less than 69% (dry V.M., more than 31%) |
| | 4. High-volatile B bituminous coal | Moist[c]B.t.u., 13,000 or more and less than 14,000[e] |
| | 5. High-volatile C bituminous coal[f] | Moist B.t.u., 11,000 or more and less than 13,000[e] |
| III. Sub-bituminous | 1. Sub-bituminous A coal | Moist B.t.u., 11,000 or more and less than 13,000[e] |

Table A-continued

Classification of Coals by Rank.[a]
(Legend: F.C. = fixed carbon; V.M. = volatile matter; B.t.u. = British thermal units)

| Class | Group | Limits of fixed carbon or B.t.u., ash free basis |
|---|---|---|
| III. Sub-bituminous | 2. Sub-bituminous B coal | Moist B.t.u., 9,500 or more and less than 11,000[e] |
| | 3. Sub-bituminous C coal | Moist B.t.u., 8,300 or more and less than 9,500[e] |
| IV. Lignitic | 1. Lignite | Moist B.t.u., less than 8,300 |
| | 2. Brown coal | Moist B.t.u., less than 8,300 |

[a]This classification does not include a few coals that have unusual physical and chemical properties and that come within the limits of fixed carbon or B.t.u. of the high-volatile bituminous and sub-bituminous ranks. All of these coals either contain less than 48% moisture and ash free fixed carbon or have more than 15,500 moist, ash free B.t.u.
[b]If agglomerating, classify in low volatile group of the bituminous class.
[c]Moist B.t.u. refers to coal containing its natural bed moisture but not including visible water on the surface of the coal.
[d]It is recognized that there may be noncaking varieties in each group of the bituminous class.
[e]Coals having 69% or more fixed carbon on the dry, mineral-matter-free basis shall be classified according to fixed carbon, regardless of B.t.u.
[f]There are three varieties of coal in the high-volatile C bituminous coal group, namely, Variety 1, agglomerating and non-weathering; Variety 2, agglomerating and weathering; Variety 3, nonagglomerating and non-weathering.

Source: A.S.I.M. D388-38 (ref. 1).

Referring to Table A above, the preferred coals when it is desirable to maximize the yield of tar reaction products quantitatively such as phenolic compounds according to the process of this invention, comprise the lowest ranked coals, the nonagglomerating, sub-bituminous and lignitic classes, III and IV.

For purposes of definition, the non-oxidizing conditions as used to describe and claim the invention refer to any condition of mining, transportation, storage, drying and reacting the coals, especially the preferred coals employed according to this invention, the lowest ranked coals, that allows for between 80 to about 99 percent especially about 90 to 99 and preferably about 95 to about 99 percent of maximum production of phenolic compounds or tar reaction products in general, employing the other enumerated and claimed reaction condition according to this invention. Maximum recovery or manufacture of phenolic compounds or other tar reaction products such as aromatic hydrocarbons and gasoline precursors, employing the reaction conditions of the present invention is based on the phenolics or other tar reaction products recovered from the coal especially the preferred coals of the present invention, the lowest ranked coals, which are at no times exposed or substantially exposed to any air or other oxidation conditions prior to hydrocarbonization.

The coal employed in the process of this invention can be any coal which is non-agglomerating under the process conditions, such as the lignites, sub-bituminous C coals and the like. Preferred non-agglomerating coals are those containing at least 15 percent oxygen, and preferably 18 to 25 percent oxygen, on an MAF basis.

Lightly to moderately agglomerating coals may be used in the process of this invention without a separate pretreatment step added to prevent agglomeration of coal particles in the fluid-bed hydrocarbonization zone. Ordinarily, such a pretreatment would be necessary in a continuous hydrocarbonization process since even those coals considered to be non-agglomerating coals such as lignites or coals from certain sub-bituminous seams are susceptible to agglomeration and tend to become sticky in a hydrogen-rich atmosphere. Moreover, feeding heavy liquid materials to the fluid-bed hydrocarbonization zone is known to cause de-fluidization of the bed due to particle agglomeration and plugging. Such heavy liquid materials may be recycled heavy tar products to be converted to lower molecular weight products, light liquids and gases. Or they may be heavy liquids from an external source which have been added to enrich the normal gas and/or liquid product, or as a means of waste disposal. However, according to the process of this invention, a separate pretreatment is not necessary for the handling of the lightly to moderately agglomerating feed materials.

Such feed materials may include the low rank coals, such as lignites and sub-bituminous C coals even some moderately agglomerating bituminous coals and also recycle product liquids. Preferred coals which may be used according to the process of this invention without any pretreatment step added to prevent agglomeration comprise the lowest ranked coals, the non-agglomerating, sub-bituminous and lignitic classes, III and IV of Table A above, the non-caking bituminous coals referred to in Table A and a few moderately agglomerating or caking-coals.

More highly agglomerating coals, such as most bituminous coals, are strongly agglomerating in a hydrogen atmosphere. They can not be handled conventionally even with a pretreatment step. These coals may now be handled without an injurious degree of defluidization by the process of this invention alone or in combination ith a pretreatment step, if necessary. If a pretreatment step is necessary, the needs for pretreatment are milder and cost less. For example, even after heavy conventional pretreatment, the use of a highly agglomerating coal such as Pittsburgh Seam Coal, in a hydrocarbonization process, presents the problem of agglomeration occurring in the fluid-bed hydrocarbonization zone. However, it is beneficial to use the process of this invention to overcome this agglomerating problem.

Those skilled in the art will recognize that any number of suitable pretreatment steps may be applied in combination with the process of this invention for the handling of coals which are either highly agglomerating or highly agglomerating in a hydrogen-rich atmosphere. These pretreatment steps include, for example, but are not limited to, chemical pretreatment, such as oxidation, or mixing with inert solids such as recycle char. It should be noted, however, that when coal is subjected to an oxidation type pretreatment to prevent agglomeration in the hydrocarbonization zone, the oxidation of the coal also results in a quantitative loss in the maximum realizable amount of tar product.

Coal particles in a particulate state may be used in the process of this invention. The coal size can be about 8 mesh or less, with particle sizes of less than about 20 mesh being preferred. There is no need to remove very fine particles, but it is desirable to minimize them by appropriate selection of the grinding process.

According to the improved process of this invention, the coal particles are preheated before entering the hydrocarbonization zone. The coal particles are in a dense phase flow. By dense phase as used throughout the specification is meant a concentration of solids in fluidizing gas of from about 5 pounds to about 45 pounds of solids per cubic foot of gas more typically from about 15 pounds to about 40 pounds of solids per cubic foot of gas. A dense phase of coal particles should be distinguished from the dilute phase wherein the concentration of solids in fluidizing gas is typically from about 1 pound to about 2 pounds of solids per cubic foot of gas. In coal conversion processes employing a dilute phase flow of coal particles, preheating steps have generally involved passing the coal particles around hot pipes or using large quantities of hot gases to impart heat to the coal particles directly. Indirect heat transfer in coal conversion processes employing a dilute phase flow of coal particles is uneconomical and impractical due to the inherently poor heat transfer coefficients of the pipelines in dilute phase flow, approximately 1 BTU to 2 BTU per hour per ° F per square foot of inside surface area of the pipeline. However, it has been found that a dense phase flow of coal particles may be conveniently and economically preheated by indirect heat transfer means.

In the hydrocarbonization process of this invention, the flow of coal particles in dense phase provides the following benefits. The quantity of coal transferred and heated per unit of pipe cross-sectional area not only exceeds that obtainable in dilute phase flow but also uses less power. A cubic foot of gas conveys 15 to 30 times more coal particles in dense phase flow than in dilute phase flow. The use of a comparatively small amount of conveying gas in dense phase flow may be extremely beneficial downstream if, for example, flue gas or nitrogen gas is used as the conveying gas. Large amounts of conveying gas other than hydrogen-rich gases or recycle gas are undesirable in the fluid-bed hydrocarbonization zone and must be separated from the coal particles before entering the fluid-bed by suitable equipment such as a cyclone separator or the like. Moreover, if such a separation is desired, in dense phase the coal particles are more easily separated from the conveying gas before entering the fluid-bed hydrocarbonization zone. Also, power requirements are intrinsically smaller in dense phase flow due to lower carrier gas velocities. In dilute phase flow, the linear velocity of carrier gases is between 50 and 100 feet per second to prevent entrained coal particles from settling out in pipelines. However, in dense phase flow, the linear velocity of carrier gases may be about 20 feet per second and sustain steady flow in the pipelines.

According to the process of this invention, a dense phase flow of coal particles is preheated by indirect heat transfer means to a temperature up to about 420° C. For example, a dense phase of coal particles may flow through a multiplicity of parallel pipelines which are externally heated. The heat transfer coefficient of the pipeline has been found to approximate that found in heat transfer through the walls of a fluid-bed, about 20 to about 40 BTU per hour per square food of inside surface area per ° F. The externally heated pipelines which the coal particles pass through are heated to a predetermined temperature sufficient to raise the temperature of the dense phase of coal particles up to a temperature of about 400° C upon exiting the externally heated pipelines.

The object of preheating the coal is to satisfy partially the enthalpy demand of the adiabatic-type hydrocarbonization reaction. Additional heat is supplied by the heat of reaction and by preheat added to process gases. The enthalpy demand consists of the heat required to raise the temperature of coal and process gas from their initial value to reaction temperature plus small heat losses. The actual temperature to which the coal feed must be preheated is, therefore, a function of the preheat added to process gases, and in the extreme may be ambient temperature i.e., zero preheat.

After being preheated to the desired temperature, the dense-phase flow of coal particles is reacted with hydrogen in the fluid-bed hydrocarbonization zone. Both agglomerating and non-agglomerating type coals may be employed in the continuous process of this invention without defluidization of the fluid-bed and plugging type problems. Agglomeration of coal particles in a fluid-bed may be substantially prevented by introducing solid coal particles into the fluid-bed hydrocarbonization zone at a high velocity.

Coal particles, especially caking, swelling or agglomerating coals become sticky when heated in a hydrogen-rich atmosphere. Even non-caking, non-swelling and non-agglomerating coals become sticky when heated in such an atmosphere. Coal particles begin to become sticky at temperatures in the range of about 350° C to about 500° C, depending on the specific properties of the coal, the atmosphere and the rate of heating. The stickiness results due to a tarry or plastic-like material forming at or near the surface of each coal particle, by a partial melting or decomposition process. On further heating over a time period, the tarry or plastic-like material is further transformed into a substantially porous, solid material referred to as a char. The length of this time period, generally in the order of minutes, depends upon the actual temperature of heating and is shorter with an increase in temperature. By plastic transformation as used throughout the specification is meant the hereinabove described process wherein surfaces of coal particles being heated, particularly when heated in a hydrogen atmosphere, develop stickiness and transform into substantially solid char, non-sticky surfaces. Plastic transformation is undergone by both normally agglomerating coals and coals which may develop a sticky surface only in a hydrogen-rich atmosphere.

Agglomerating or caking coals partially soften and become sticky when heated to temperatures between about 350° C to about 500° C over a period of minutes. Components of the coal particles soften and gas evolves because of decomposition. Sticky coal particles undergoing plastic transformation tend to adhere to most surfaces which they contact such as walls or baffles in the reactor, particularly relatively cool walls or baffles. However, contact with other sticky particles while undergoing plastic transformation results in gross particle growth through adherence of sticky particles to one another. The formation and growth of these agglomerates intereferes drastically with the maintenance of a fluid-bed and any substantial growth usually makes it impossible to maintain fluidization.

In particular, entrance ports and gas distribution plates of equipment used in fluid-bed coal conversion processes become plugged or partially plugged. Furthermore, even if plugging is not extensive, the sticky particles tend to adhere to the walls of the vessel in which the operation is conducted. Continued gross particle growth and the formation of multi-particle conglomerates and bridges interfers with smooth operation and frequently results in complete stoppage of operation.

Agglomeration of coal particles upon heating depends on operating conditions such as the heating rate, final temperature attained, ambient gas composition, coal type, particle size and total pressure. When heated in a hydrogen atmosphere, even non-agglomerating coals, such as lignites or coals from certain sub-bituminous seams, are susceptible to agglomeration and tend to become sticky in a hydrogen atmosphere. Thus, agglomeration of coal particles is accentuated in a hydrocarbonization reactor where heating in the presence of a hydrogen-rich gas actually promotes formation of a sticky surface on the coal particles reacted.

In a corresponding application filed concurrently herewith, "Method of Avoiding Agglomerating in Fluidized Bed Processes" by C. W. Albright and H. G. Davis, it is taught that agglomeration of a fluidized bed may be substantially prevented by introducing solid coal particles into a fluid-bed reaction zone at a high velocity. The fluid-bed is conventionally maintained by passing a fluidizing medium through finely-divided solid particles. "Introduction velocity" as used throughout the specification means the velocity of carrying gas through a device which causes the solids or liquid velocity to approach the maximum theoretical ratio to gas velocity, i.e., 1 to 1. By a high velocity is meant a velocity sufficient to rapidly and uniformly disperse fresh coal particles entering the fluid-bed at a temperature below the plastic transformation-temperature within a matrix of non-agglomerating particles in the fluid-bed. The non-agglomerating particles preferably are the hot, partially reacted coal particles and char particles situated within the fluid-bed reaction zone. Due to the difference of temperature between the entering coal particles and the reaction zone, the entering particles tend to agglomerate as heat transfers from the reaction zone to the entering coal particles. However, it has been found that when introduced in the fluid-bed at a high velocity, the entering coal particles rapidly and uniformly disperse within a matrix of non-agglomerating particles within the fluid-bed before being heated up to the plastic transformation-temperature range.

By this process, the entering, sticky or potentially sticky coal particles are rapidly distributed and brought into intimate association with non-sticky, hot particles situated within the fluid-bed reaction zone. The entering particles do not substantially adhere to the charry surfaces of these non-agglomerating hot particles which have passed through the plastic transformation-temperature range or are inherently non-agglomerating. The hot, non-agglomerating particles at bed temperature rapidly transfer heat to the entering coal particles causing them to transverse the plastic transformation-temperature range swiftly without contacting significant numbers of other sticky coal particles beforehand.

A velocity rate useful in the method of this invention may be obtained by any suitable means. For example, a narrow inlet port or any other inlet means which narrows or necks down the cross-sectional area of the passageway to the inlet where the fresh coal particles enter the reactor may be employed to accelerate the coal particles to a high velocity. In addition, process gas may be physically added to the fluidized stream of fresh coal at a point before the fluidized stream enters the reaction zone. The addition of process gas increases the flow rate of the fluidized stream and hence the velocity of the coal particles. An amount of process gas sufficient to achieve the desired entrance velocity of coal particles should be used.

Since the fluidized coal particles are transported through the lines in a dense phase flow, high velocity flow rates are usually unnecessary and undesirable due to the abrasive characteristics of coal. A high velocity, dense phase flow or coal particles throughout the lines would have required wear plates to be installed throughout the lines to control the otherwise rapid erosion rate of the lines, such wear plates being an undesirable expense. However, according to the present invention, only a small surface area will be exposed to abrasive wear and this part may be replaced readily and economically with little or no downtime of the system.

By maintaining the distance for transport between feeder and reactor minimal, a high velocity dilute phase or an intermediate dilute phase flow may be employed in the line or lines connecting the feeder and reactor. The increased wear and/or need for wear-resistant material is offset by the increased separation and dilution of coal particles on introduction into the reactor at a high velocity. This makes some additional contribution to avoiding agglomeration.

For example, an inlet means comprising a material having a wear-resistant surface may preferably be employed in this invention as a means for increasing the velocity of coal particles entering the reaction zone and as a means of controlling the manner of entry i.e., in a solid stream or in a fan-like uniform distribution. Use of such an inlet means lengthens the wear time of the surface exposed to the high erosion rate caused by the high velocity flow of coal particles.

Suitable wear-resistant surfaces would be composed of materials such as tungsten carbide, silicon carbide or other wear resistant materials known in the art in any combination or mixture thereof. For clarity and illustrative purposes only, the description of this invention will be mainly directed to the use of tungsten carbide as the wear-resistant surface of the material that reduces erosion in the lines although any number of other wear-resistant materials can be used successfully according to this invention.

An inlet means such as a nozzle which comprises a transfer line having a reduced or constricted cross-sectional area may be employed in the method of this invention. The length to cross-sectional area ratio of the nozzle should be sufficiently large enough so that the desired velocity of injection for the solid coal particles or non-vaporizable recycle oil may be achieved. A length to cross-sectional area of this section of transfer line of greater than about 5 to 1 is desirable, greater than about 10 to 1 preferable, and greater than about 20 to 1 more preferable. This allows for a finite distance which the coal particles and/or non-vaporizable recycle oil require for acceleration to the velocity approaching that of the carrying gas.

According to this invention, it is preferable to introduce a fluidized stream of coal particles into the lower end of a fluid-bed hydrocarbonization zone. More preferably the particles are introduced into the hydrocarbonization reactor through at least one inlet in the reactor in a vertically upwards direction. The inlet is situated substantially in the vicinity of the vertical axis at or near the reactor bottom. The coal particles are introduced at a velocity sufficient to mix the fresh coal having a temperature below the plastic transformation-temperature rapidly with non-agglomerating particles such as partially reacted coal and char particles in the reaction zone at the reaction temperature thereby substantially preventing agglomeration of the fluid-bed.

In the reactor which preferably is substantially vertical, the natural circulation of coal particles within the fluid-bed hydrocarbonization zone is a complex flow pattern. However, it may be described approximately by dividing the hydrocarbonization zone into two concentric sub-zones, an inner sub-zone and an outer sub-zone surrounding the inner sub-zones.

In the inner sub-zone which is situated substantially within the axially central portion of the reactor, coal particles flow in a generally ascending path. In the outer sub-zone, which is situated substantially near the walls of the reactor, coal particles flow in a generally descending path. Advantages of introducing the coal particles into the fluid-bed of the reactor in an essentially vertically upwards direction are that the natural circulation of coal particles in the fluid-bed is enhanced and the coal particles get at least a minimum residence time. Introduction of coal particles into the fluid-bed of the reactor promotes a channeled circulation of particles within the hydrocarbonization zone along the natural circulation path. Circulation eddies, are thus enhanced and promote the dispersion of the entering coal particles within the fluid-bed hydrocarbonization zone. Moreover, when introduced in this manner, the coal particles are ensured of not immediately and directly striking the sides of the vessel wherein the hydrocarbonization occurs, a result which could lead to unnecessary and undesirable agglomeration.

The fluidized coal particles should be introduced into this inner sub-zone, the central upflow zone within the reactor. The central upflow zone extends radially from the vertical axis of the reactor to an area where the outer-sub-zone, the peripheral downflow zone begins. It is essential that the coal particles be introduced into the central upflow zone in order to avoid striking the walls of the reactor or entering the peripheral downflow zone. Preferably, the coal particles are introduced through the base or bottom of the reactor at one or more inlets situated in the vicinity of the point where the vertical axis of the reactor intersects the base of the reactor.

It has been discovered that introducing a fluidized stream of coal particles into a dense phase, fluid-bed hydrocarbonization zone at a velocity of more than about 200 feet per second in a manner described hereinabove substantially prevents agglomeration or caking of the fluid-bed. When a lower injection velocity, for example, about 100 feet per second is used, agglomeration of the fluid-bed is not prevented. In order to substantially prevent agglomeration of the fluid-bed hydrocarbonization zone, coal should be introduced at a high velocity into the zone in a high velocity stream, i.e., at a velocity more than about 200 feet per second, and preferably more than about 400 feet per second in the manner described hereinabove.

The hydrocarbonization zone is maintained at an average temperature of from about 480° C to about 600° C by known heating methods. Preferably, a combination of preheat and heat of reaction is used to maintain the hydrocarbonization zone adiabatically at these temperatures. Although any convenient source of heat can be employed, it has been found that, when the feed coal is preheated in the range of about 250° C to about 300° C, preferably between about 250° C and about 420° C, the exothermic heat of reaction in the hydrocarbonization zone is sufficient to maintain the desired reaction temperature. It is also desirable to similarly preheat the process gas. Although temperatures of less than 480° C can be employed, they are generally not desirable because the rate of reaction of coal with hydrogen is too slow for a practical process. The temperature must not exceed about 600° C, however, for at these more elevated temperatures, several deleterious reactions occur during even the minimum residence times practicable in the kind of reaction described. Oxygen is more completely converted to water and carbon oxides, heavy liquid products are converted to coke and lighter liquids and gases, and hydrogen consumption increases.

The temperature of reaction may be controlled at a desired point within the operating range of 480° C to 600° C by choice of and control of the preheat conditions. Temperatures in the range of 520° C to 580° C are preferred.

The gas employed can be pure hydrogen or hydrogen in admixture with an inert gas such as nitrogen or the like. For the purpose of this reaction, recycle gases such as methane and ethane may be considered to be essentially inert. However, the hydrogen partial pressure in the hydrocarbonization zone should be between about 100 p.s.i. to about 1200 p.s.i. At partial pressure of less than 100 p.s.i. the rate of reaction with the coal is too slow, and at partial pressures of greater than 1200 p.s.i. the amount of hydrogen consumed is too great for an economical process and the difficulties of avoiding agglomeration become too great for a practical and economical process. Hydrogen partial pressures of from about 300 to about 500 p.s.i. are preferred, and from about 200 to about 800 p.s.i. desirable. By the term "hydrogen partial pressure", as employed in the specification and claims, is meant the log mean average of the hydrogen partial pressure in the feed and product gas streams.

The coal, when it is fed into the hydrocarbonization zone, is rapidly hydrocarbonized, leaving a solid particulate char in the bed, which is then withdrawn from the bed. The coal is fed at a rate such that the average solid residence time in the hydrocarbonization zone is from about 1 to 30 minutes, preferably 3 to 12 minutes, and may be from about 5 to about 60 minutes, more preferably about 8 to about 30 minutes. By the term solid residence time as employed in the specification is meant the time needed to fill the empty reaction zone with reacting coal. It is calculated by multiplying the volume of the reacting zone by a fluid-bed density of coal per unit volume typically 30 to 38 pounds per cubic foot, and dividing this by the coal feed rate.

In the hydrocarbonization zone, the coal is converted to hydrocarbon-rich gas, to oil and to char in proportions which can be varied by varying temperature, time and pressure. Preferably, char yield is the minimum amount sufficient to make the hydrogen and plant fuel. Make char may be dropped through an overflow pipe to valved hot receivers, which may be intermittenly depressurized and dumped. Entrained char may be removed from the vapor overhead by cyclones or the like and returned to the bed. Oil, water and gas products may be separated by methods well known in the art such as staged condensation and the like.

As indicated above, it is the object of this invention to maximize the amount of liquid products, particularly phenolic compounds, including phenols, cresols, xylenols, ethyl phenols and the like in proportion to the amount of hydrogen consumed. It is also the object of this invention to maximize the amount of liquid and gaseous fuel products in proportion of the amount of hydrogen consumed. It has been discovered by this invention that, to obtain these objectives, not only must the process conditions be maintained within the limits set forth above, they also depend upon each other.

This interdependence of process conditions results because of the effect of each variable on product yields and hydrogen consumed. For example, the yield of tar increases with increasing time, but tends to level off at a limit, which is dependent on temperature and pressure, above which there is little or no increases in tar yield. This limit is about 10 minutes at above 540° C, and may be, at times, about 15 minutes at about 540° C, but decreases to as low as 8 minutes at 570° C. The precise limit will vary, of course, depending on the particular coal or hydrogen partial pressure employed. On the other hand, the amount of hydrogen consumed increases continuously with increasing residence time. Both the yield of tar and the amount of hydrogen consumed increase with increasing hydrogen pressure, with the amount of hydrogen consumed increasing proportionately faster.

Other desirable product mixes may be obtained by selecting appropriate operating conditions. For example, product gas yields may be increased at the expense of higher hydrogen consumption at a constant residence time and hydrogen partial pressure. As temperature increases as described above, liquid yield first increases, then reaches maximum and decreases. Gas product may be increased at the expense of liquid product by recycling all or part of the latter. On the other hand, at mild operating conditions wherein hydrogen consumption is less than about 2 percent of the weight of the MAF coal, liquid yield will be high when compared to gas yield.

The variable having the greatest effect on tar and phenolic yield per unit of hydrogen consumed is temperature. In general, the yield of tar increases slowly with temperature to a maximum, and then decreases because of hydrocracking of tar components to uncondensable gases and coke. On the other hand, the amount of hydrogen consumed increases very rapidly with temperature. In addition, the amount of oxygen in the char decreases with temperature and, once the char is depleted of oxygen, further reaction of char and hydrogen will not produce the desired phenolic products. As a result, the yield of tar and phenols per unit of hydrogen consumed remains high up to a maximum temperature dependent on residence time and pressure and then rapidly decreases.

Accordingly, to maximize the yield of phenols and tar per unit of hydrogen consumed, the process variables must conform to the relationship defined by the equation:

$$S_H = T(P)^{0.067}\,(t)^{0.067} \qquad \text{(I)}$$

wherein $S_H$ is the hydrocarbonization severity factor having a value of from 530 to 640, preferably from 560 to 630; T is the average hydrocarbonization temperature in °C; P is the log mean average hydrogen partial pressure in p.s.i. divided by 1000; and t is the solids residence time in minutes. When this relationship is observed, the weight ratio of phenolic compounds boiling below 230° C to hydrogen consumed will generally be about 3.5 to about 5 or higher. This is true for the preferred class III and IV coals. Furthermore, to maximize yield of total liquid products, the operating range for S should be 550 to 700, preferably 600 to 680.

Many products produced by the hydrocarbonization of coal in accordance with this invention are cresols and other substituted phenols which may desirably be dealkylated to form phenol. Although the dealkylation can be accomplished in a step separate from the hydrocarbonization, it has been found by this invention that, if the vapors produced by the hydrocarbonization are retained in the fluidized bed for from about 10 seconds to about 250 seconds preferably from about 30 to about 150 seconds, considerable dealkylation of the substituted phenols occurs. It has been further found that the presence of the char in the fluidized bed acts as a catalyst for the dealkylation permitting a degree of dealkylation equivalent to that obtained at higher temperatures in the absence of the char.

For optimum results from this dealkylation step, it has been found that the temperature and vapor residence time must conform to the following equation:

$$S_c - T(\theta)^{0.048} \qquad \text{(II)}$$

wherein $S_c$ is cracking severity factor having a value of from 640 to about 750, preferably 650 to 710; T is the temperature in C; and $\theta$ is the vapor residence time in seconds. In other circumstances, when it is preferable to maximize total liquid product and minimize hydrogen consumption, it may be desirable to operate at the lowest practical range of $S_c$, from 600 to 690.

The product gas comprises vapor products from the hydrocarbonization and consists mainly of gaseous products such as water, carbon dioxide, carbon monoxide, methane and the like, e.g. other hydrocarbons, as well as unreacted hydrogen, and condensable tar fraction. The tar fraction can be readily distilled to recover valuable chemicals, including phenols. The tar contains a sizeable quantity of material boiling at temperatures in excess of about 230° C which is useful mainly as a fuel. It has been found by this invention, however, that this high boiling material can be recycled to the hydrocarbonization zone to be hydrocracked to compounds boiling below 230° C, thereby permitting substantially all of the vapor products produced by the hydrocarbonization to be recovered as valuable, low-boiling chemicals. The high-boiling material is fed to the hydrocarbonization zone at a point sufficient to permit conversion of about 25 to 40 percent of the recycled materials to products boiling below about 230° C. In this manner the over-all yield of low boiling phenolic materials is increased and the ratio of phenols produced to hydrogen consumed is also increased. Because this material will flash vaporize when fed to the hydrocarbonization zone, the hydrocarbonization is still conducted in the dry phase. By this modification, the three process steps of hydrocarbonization, dealkylation of substituted phenols, and a secondary hydrocracking of coal tars are conducted simultaneously.

It has also been found by this invention that this tar or fraction of it may be recycled to the hydrocarbonization reaction and thereby converted to lower boiling liquids, gases and char. Such recycle can be accomplished without agglomerating the fluid-bed if the recycle liquid is injected at a sufficiently high velocity as described above to admix it rapidly with partially reacted coal and char particle and at such an angle as to avoid its sticking to the walls or intervals of the bed before reacting or vaporizing.

The char produced by the hydrocarbonization process of this invention is very reactive and contains fairly large quantities of hydrogen, generally about 4 weight per cent of an MAF basis. It has been found that if the char is heated to a temperature of 800° to 900° C or higher, preferably 840° to 800° C, one can obtain a gas stream containing about 75 to 85 volume per cent hydrogen, with the balance comprising mainly carbon monoxide and methane. This hydrogen stream, after removal of the contaminants, can be employed as the fluidizing gas, thereby substantially lessening the requirement for hydrogen from some other source. It is preferred that this "calcination" process be conducted in a fluidized bed, employing, for example steam as the fluidizing medium. The pressure is preferably atmospheric. The solid residence time in the calcination zone can vary from about 2 to about 10 minutes, and is preferably from about 3 to about 7 minutes. When steam is the fluidization gas, partial reaction occurs augmenting the hydrogen and carbon monoxide yields. It is not intended to restrict the method of using the char to this process, however, for the char is suitable as feed to any of several commercial or proposed gasification processes.

The manner in which the invention is carried out will be more fully understood from the following description when read with reference to the accompanying drawings which represent semi-diagrammatic views of embodiments of a system in which the process of this invention may be carried out.

FIG. 1 illustrates coal supply vessels 10 and 16 a coal feeder 22, preheater 30 and reactor vessel 40. Lines are provided for conveying finely divided coal through the vessels in sequence. A line 26 conveys the coal from the pick up chamber 18 to preheater 30. A line 34 conveys the coal from preheater 30 into reactor vessel 40. A line 44 conveys devolatized coal (termed "char") from reaction vessel 40 for recovery as solid product or for recycle. A line 42 is provided for conveying liquid and vapor products from reation vessel 40 for further processing and/or recycle.

According to the process of this invention, the feed coal is in particular form, having been crushed, ground, pulverized or the like to a size finer than about 8 tyler mesh, and preferably finer than about 20 Tyler mesh. Furthermore, while the feed coal may contain adsorbed water, it is preferably substantially free of surface moisture. Any such adsorbed water will be vaporized during preheat. Moreover, any such adsorbed water must be included as part of the intert carrying gas and must not be in such large quantities as to give more carrying gas than required. Coal particles meeting these conditions are herein referred to as "fluidizable".

The coal supply vessels 10 and 16 each can hold a bed of fluidizable coal particles, which are employed in the process. Coal supply vessel 10 is typically a lock-hopper at essentially atmospheric pressure. Coal supply vessel 16 is typically a lock-hopper in which fluidized coal can be pressurized with process gas or other desired fluidization gases.

Operation of vessel 10, 16 and 22 can be illustrated by describing a typical cycle. With valves 14 and 20 closed, lock-hopper 16 is filled to a predetermined depth with coal from lock-hopper 10 through open value 12 and line 11 at essentially atmospheric pressure. Then, with valves 12 and 20 closed, lock-hopper 16 is pressurized to a predetermined pressure above reaction system pressure through open valve 14 and line 13. Valves 12 and 14 are then closed and coal is introduced into fluidized feeder vessel 22 through open valve 20 and line 17. The cycle about lock-hopper 16 is then repeated. A typical time for such a cycle is from about 10 to about 30 minutes. With valve 20 closed, fluidized coal is fed at a predetermined rate through line 26 to the downstream-process units. Other variations of the feeding cycle to the fluidized feeder are possible, of course, but they are not illustrated herein since they do not form the inventive steps of this process.

In fluidized feeder 22, a fluidizing gas passes through line 24 at a low velocity sufficient to entrain the fluidized coal and convey it in dense phase flow through line 26 and into the bottom of coal preheater 30, or directly to line 34 if no preheat is required. Alternately, additional gas could be added to the line conveying the coal in a dense phase flow through line 26 to assist in the conveyance. Any non-oxiding gas can be used as the fluidizing gas, e.g. fuel gas, nitrogen, hydrogen, steam and the like. However, it is preferable, in general, to use reaction process gas or recycle product gas.

Coal preheater 30 is a means to rapidly preheat, when desirable, the finely divided coal particles, under fluidized conditions, to a temperature below the minimum temperature for softening or significant reaction range, in the substantial absence of oxygen. Preferred temperatures are from about 200° C to about 375° C and particularly preferred are from about 325° C to about 375° C. The stream of gas-fluidized coal in dense phase is heated upon passing rapidly through the heater having a very favorable ratio of heating surface to internal volume. The coal is heated in heater 30 to the desired temperature by any convenient means of heat exchange, e.g. by means of radiant heat or hot flue gas such as depicted in FIG. 1 as entering the bottom of heater 30 through line 28 and exiting at the top of the heater vessel 30 through line 32. It is recognized, however, that the amount of coal preheating needed may be minmized by preheating process gas to an elevated temperature.

Preheated fluidized coal particles exit preheater 30 through line 34 and enter the lower end of the reactor vessel 40 substantially near the center of the bottom i.e. where the vertical axis intersects the bottom of reactor 40. According to this invention, the coal particles are introduced into the lower end of the fluid-bed reaction zone at a high velocity. This high velocity may be achieved by accelerating the fluidized stream of coal particles to the desired velocity along a constricted path of confined cross-section. A nozzle, narrow inlet port, tapered channel, or any inlet means which narrows, constricts or necks down the cross-sectional area of the passageway to the inlet where the fluidized coal particles enter the reactor may be used to accelerate the fluidized stream of particles to the desired velocity. The stream of preheated, fluidizable coal particles is introduced into the central upflow zone of the fluid-bed within the reaction vessel at a high velocity in an essentially vertically upwards direction into and through the substantially axially central portion of the bottom of the reaction vessel.

Recycle oil may be bed into reactor 40 through line 36. Injection of the recycle is also preferably at a stream velocity of about 200 feet per second or greater, and more preferably about 400 feet per second or greater into the lower end of the fluid-bed reaction zone within the reactor vessel in an essentially vertically upwards direction. Like the entering coal particles, the recycle oil stream follows a substantially ascending path about a substantially axially dentral portion of the reactor vessel. In the injection of the recycle oil and fluidizable coal particles, it is essential that they be introduced into the reactor vessel in such a way that they do not immediately and directly strike the walls of the reactor vessel, a result which could lead to unnecessary and undersirable agglomeration.

Only one inlet each for entry of the preheated coal particles and the recycle oil is shown in FIG. 1. These inlets may also represent a multiplicity of inlets for ease of operation of this process. A multiplicity of inlets may be desirable, for example, where the reactor is large or when separate recycle streams of oil are being innjected separately into the reactor. The entry points for the coal particles and/or recycle oil are preferably situated near the intersection of the vertical axis with the reactor bottom. Each stream of coal particles and/or recycle oil is preferably introduced at a high velocity at each inlet in an essentially vertically upwards direction, the inlet situated at or near the reactor bottom, preferably in the vicinity of the vertical axis. In this manner, the separate stream of entering carbonaceous material are kept separate and apart until rapidly mixed in the fluid-bed with partially reacted coal and char particles.

Char from reactor vessel 40 is continously removed through line 44 to valved hot receivers (now shown), which are intermittently depressurized and dumped.

Char product is, in fact partially reacted coal, which at the temperature of the reactor is continuing to evolve small quantities of tars and other vapors. It is necessary to seal the gases and vapors of the reactor from entering into the char receiver by use of a blowback. Also, at the temperature of the reactor, between about 480° C and about 600° C, design and operation of the hot valves between reactor and char receiver are ordinarily extremely difficult. For this reason, it is necessary to lower the temperature of the product char below the reaction temperature, preferably to a temperature between about 300°C and about 375°C.

Lowering char product temperature prevents evolution of tars which otherwise plug lines and valves of the char receiver, and allows continuous operation of the hot valves. It is also, desirable to maintain at least minimum fluidization in line 44 charrying product char from reactor 40 to receiver. This may be accomplised by introducing a small, calculated flow of liquid water or other non-charring volatile liquid into the take-off line 44 at one or more points directly above the hot valve or valves (not shown). The steam or vapor generated by vaporization of the added water or other liquid, may serve the fluidization and blow-back needs alone or augmented by small amounts of suitable blowback gases, such as product recycle gas, hydrogen or steam.

Liquid and vapor products are removed from the reactor vessel through line 42. Entrained char may be removed from the vapor overhead by cyclones (not shown) and returned to the bed and injected at high velocity, if desired, to assist in reducing agglomerating of the fluid-bed to hydrocarbonization zone. Oil, water and gas products may be separated by staged condensation. The oil stream may be quenched to cool the stream down to a temperature wherein the light gases and low boiling liquid and water vapor go to the top of a column and the heavy oil goes to the bottom. A heat exchanger, for example, may be used to cool a heavy quench oil cycle and manufacture steam. The bulk of the phenolic product remains with the heavy oil, and water and part of the phenolics remains with the light oil which may be recycled through line 36. The water product contains phenolics, bases and the like and needs to be decontaminated or cleaned up with or without recovery of the phenols and or base for sale before being dumped or reused. If phenol and cresols are desired as separated products, this product water may be used in a phenols extraction step.

Fluidization gas is fed into the reactor vessel 40 through line 38. The gas preferable is a hydrogen-rich oxygen-free gas.

The following examples are illustrative of the concept of this invention, demonstrating the method of preventing agglomeration of coal in fluidized bed processes via the high velocity injection of coal particles into a reaction zone.

EXAMPLE I

The apparatus employed, shown schematically in FIG. 1 of the drawings, comprise two coal feed lock-hoppers (10, 16) connected in parallel to a fluidized feeder 22, a preheater 30 and reactor 40. The entire coal conveying line was constructed of ⅜-inch I.D. by ⅝-inch O.D. tubing. The two coal fed lock-hoppers (10, 16) that fed the fluidized feeder alternately each had a 7-inch I.D. and height of 8 feet. The fluidized feeder 22 had a 24-inch I.D. and height of 20 feet. The preheater 30, a lead bath heated by "surface combustion" burners had a 24-inch I.D. height of 12 feet. The reactor 40 had an 11-inch I.D. fluid bed, a bed depth of 17-½ feet and inside cross-sectional area of 0.66 sq. feet.

The average velocity through the dense phase coal feed line was not particularly high, the maximum velocity being approximately 40 feet per second at the inlet to the reactor and only 15 feet per second at the outlet of the coal feeder, erosion of the pipe at these velocities still remaining at an acceptable level. Attempts to feed the coal into the reactor at velocities of approximately 100 feet per second resulted in agglomeration and coking-up of the fluid-bed. A 15/32-inch diameter tungsten-carbide nozzle was used to increase the rate at which coal and hydrogen were introduced into the reactor to 200 feet per second and provide an erosion resistance surface.

In operation, the reactor was filled with coal and slowly heated up toward the target condition and gas flows and pressures were established. Hydrogen was employed as the gas phase. When the target conditions were established the coal feed was begun. On the termination of the run the reactor was opened up. No large agglomerates or coke particles were found. The operating conditions during the hydrocarbonization are shown in Table I below:

TABLE I

LAKE DE SMET COAL
(Operating Conditions)

| Run Number | 1 | 2 | 3 | 4** |
|---|---|---|---|---|
| Reactor Pressure | 500–600 psig. | 600 psig. | 400–1000 psig. | 700 psig. |
| Reactor Temperature | *470° C–520° C | *470° C–520° C | 480° C to 570° C | 520° C–560° C |
| Fluidization Velocity | 0.5 ft/sec | 0.5 ft/sec | 0.25 ft/sec–0.5 ft/sec | 0.5 ft/sec |
| Coal Feed Rate | 1000–1200 lb/hr | 1000–1200 lb/hr | 600–1000 lb/hr | 1000 lb/hr |
| Feed Gas to the Reactor | Hydrogen | Hydrogen | Hydrogen | Hydrogen |
| Length of Run | 45 hours | 34 hours | 78 hours | 29 hours |
| Coal Injection Velocity | 200 ft/sec | 200 ft/sec | 200 ft/sec | 200 ft/sec |
| Nominal Solids Residence time in bed | 18–22 minutes | 18–24 minutes | 19–46 minutes | 9.4 minutes |

*Initially 470° C and increased in 10° C increments every 6 hours with the added restriction that the reactor was cooled to 450° C–470° C after a coal feed stoppage and before starting the coal feed again.
**Bed depth of the reactor was shortened, to 7 ft. 2 inches for this run. The analysis of the feed, is summarized in TABLE II below:

TABLE II

LAKE DE SMET COAL, WYOMING,
SUBBITUMINOUS C (ANALYSIS)

| Moisture and Ash Free Basis | Weight Percent |
|---|---|
| C | 72.0 |
| H | 5.3 |
| N | 1.3 |
| S | 1.0 |
| O | 20.4 |
| Ash | 11.9 (dry basis) |
| Water | 30 (as received) |

EXAMPLE II

Two additional runs were conducted employing apparatus and procedures similar to those employed in Example I, except that oil, the higher boiling fractions of the liquid products, was recycled to the reactor. These additional runs were conducted to determine whether a high velocity injection of heavy oil could be fed to the reactor without agglomerating the fluid bed. The oil recycle equipment added to the pilot plant apparatus comprised a storage tank, to hold the recycle oil, an oil preheater to preheat the oil prior to injection into the reactor.

The main hydrogen stream to the reactor was split into two roughly equal streams, each of which was preheated to 300°C to 350°C. The heavy recycle oil was pumped into one of these hydrogen streams and injected into the reactor through a ¼-inch diameter tungsten carbide nozzle at approximately 400 feet per second. The nozzle, which pointed vertically up the reactor, was located in the center of the reactor bottom 5 feet about the coal inlet. The other hydrogen stream was mixed with the preheated coal, and introduced into the bottom of the reactor through a 15/32-inch diameter tungsten-carbide nozzle at approximately 160 feet per second in a vertically upwards direction. The date for these runs are summarized below in Table III.

TABLE III

| Run | 1 | 2 |
|---|---|---|
| Coal Feed Rate | 1000 lb/hr | 1000 lb/hr |
| Coal Feeder Pressure | 1100 psig | 1100 psig |
| Reactor Pressure | 500 psig | 500 psig |
| Reactor Temperature | 550 C | 580 C |
| Reactor Fluidization Velocity | 0.5 ft/sec | 0.5 ft/sec |

TABLE III-continued

| Run | 1 | 2 |
|---|---|---|
| Length of Run | 5 hrs | 5 hrs |
| Recycle Oil Feed Rate | 100 lb/hr | 240 lb/hr |
| Coal - $H_2$ inlet velocity | 160 ft/sec | 160 ft/sec |
| Oil - $H_2$ inlet velocity | 420 ft/sec | 420 ft/sec |

No problems were enclountered in making these runs. There was no evidence of agglomeration in the fluid bed, even when injecting oil at the 240 lb/hr rate.

EXAMPLE III

The bench-scale apparatus employed in this example comprised a pulverized solid hopper having a solid's capacity of 4.5 liters and constructed from a 3-inch diameter by 4-foot high schedule 80 carbon steel pipe; a reactor was made of 1-inch I.D. by 9-inch high stainless steel tube having a ¼-inch wall thickness and expanded head 4-inches high and 2 inches I.D.; solids overflow line constructed of ½-inch Schedule 40 pipe; a vapor line constructed from ⅜-inch O.D. stainless steel tubing; and a solids feeder. Two liquid feed pumps, Lapp Microflow Pulsafeeders were used, one to feed the liquid being investigated and the other to feed water for steam generation. Electrically heated liquid and water vaporizer and superheaters constructed of ¼-inch O.D. stainless steel tubing were installed between the feed pumps and the feed injection nozzle to the reactor. Thermocouple located 3, 6, 8 and 11-inches from the bottom of the reactor were installed in a ¼-inch O.S. thermowell placed axially in the center of the reactor. The lower three thermocouples were in the fluidized bed while the upper thermocouple was in the vapor space above the bed.

In operation, tars boiling above 235° C obtained from hydrocarbonization of Lake de Smet Coal were employed as the feedstock to the reaction zone for conversion to oils boing below 230° C. The tars were distilled from the whole liquid produce obtained from the hydrocarbonization into various distillation fractions and a blend of these distillation fractions used in this example had a nominal atmospheric temperature range for 75% of the tar between 235° C and 460° C. The remaining 25% boiled above 460° C.

The solids feed hooper was filled with Lake de Smet hydrocarbonization char as described herein above. The water and tar feed reservoirs were filled and heated to operating temperature. During the heat up period, a predetermined flow of hydrogen passed through the empty reactor. As soon as operating conditions were approached, the char feed and water feed (superheated steam by the time it entered the reactor through the injection orifice) were started. The three thermocouples located in the fluidized bed, at the levels indicated hereinabove, served as an indication of bed behavior. Attempts to feed this tar stream at velocities of 100, 200 and 300 feet per second resulted in rapid agglomeration of the fluidized reactor bed. A 26-gauge hypodermic needle was used to achieve a 400 feet per second injection velocity of the whole tar feed. Using this inlet velocity for the whole feed, coking up of the fluidized bed within the reactor was prevented under the following operating conditions contained in Table IV.

TABLE IV

| OPERATING CONDITIONS — LAKE DE SMET COAL | |
|---|---|
| Pressure | 150 psig |
| Hydrogen Partial Pressure | 115 psig |
| Residence time of Vapors in char bed based on superficial linear velocity | 1.33 sec |
| Char Feed | 250 g/hr |
| Oil Feed Rate | 2 ml/min |
| Water (as steam) Feed | 3 ml/min |
| Hydrogen Flow to Reactor | 35 SCFH |
| Moles Hydrogen/Moles Water | 45/1 |
| Temperature | 650° C |
| Superficial Linear Velocity of hydrogen | 0.5 ft/sec |
| Time of Run | 5 hrs. |
| Fluidizing Gas | Hydrogen |

EXAMPLE IV – XXII

Figure 2:
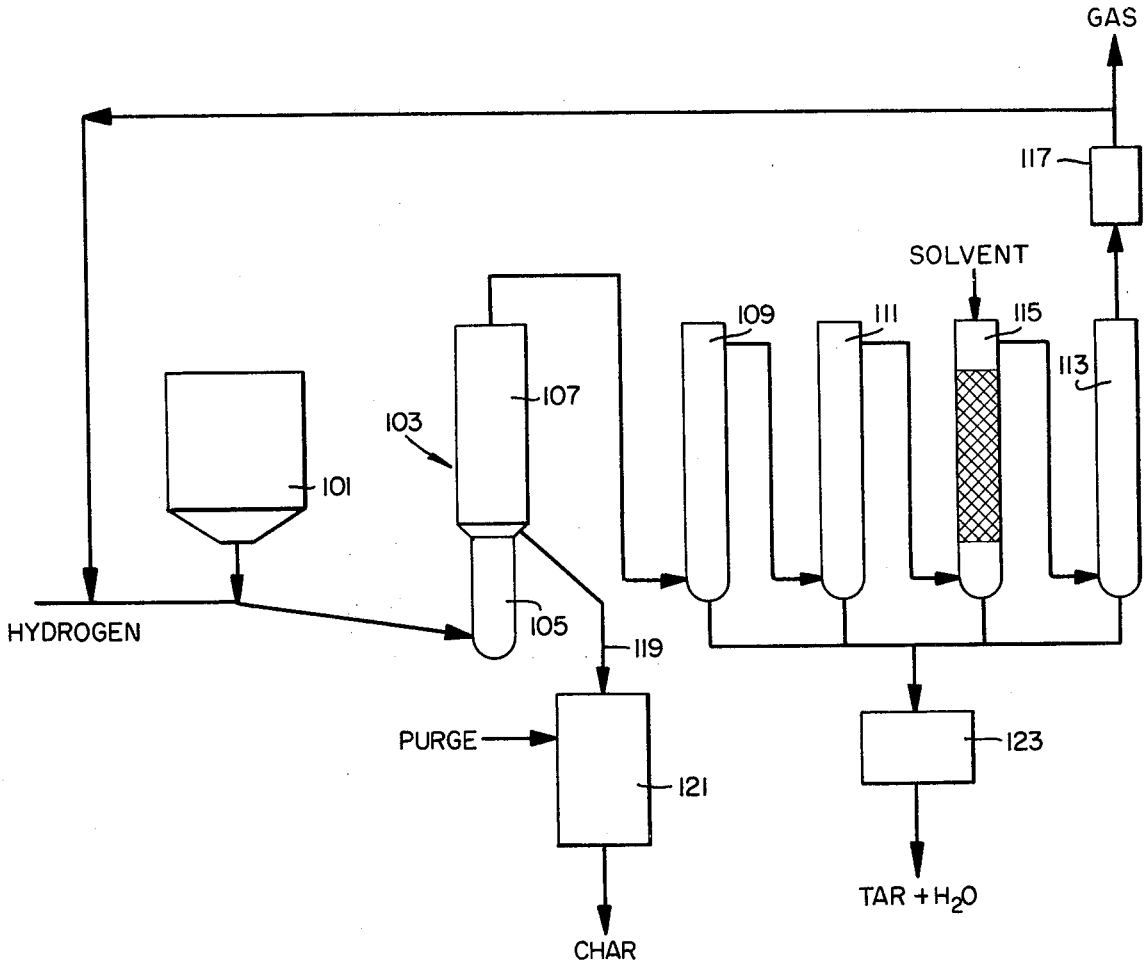

The apparatus employed in these examples is shown schematically in FIG. 2 of the drawings, and consisted essentially of coal hopper 101 having a 3500-gram capacity constructed from a 3-inch diameter by 4-foot high schedule 80 carbon steel pipe; reactor 103 comprising reaction zone 105 constructed from a 1-inch I.D. by 9-inch high stainless steel tube having a ¼ inch wall thickness and expanded head 107 constructed from a 2-inch diameter by 18-inch high schedule 80 pipe; steam-cooled condenser 109; two water-cooled condensers 111 and 113; and gas recycle compressor, not shown. To ensure removal of condensibles from the vapor stream, the system also employed either solvent scrubber 115 or activated carbon trap 117. Reactor 103 was equipped with an axially-mounted thermowell, not shown, containing four thermocouples located one, four, seven and twelve inches from the bottom of reactor 103.

In operation, hopper 101 is charged with a weighed amount of 40 –100 mesh subbituminous C coal which was mined and immediately store under water. The coal is brought to the reactor and dewatered and dried under non-oxidizing conditions. The system is purged of air, reactor 103 is heated to about the desired reaction condition and gas flows and pressures are established. Hydrogen from gas cylinders is employed as the gas phase. When the desired temperature, pressure and gas flow rates are established, the coal feed is begun and continued until the hopper is empty, at which time the system is shut down and cooled. During the run, char is removed from reactor 103 through overflow line 119 and collected in char receiver 121, and tars and water are allowed to accumulate in condensers 109, 111 and 113 and scrubber 115, if employed.

On the termination of the run, the char receiver is emptied and the char is weighed. The condensers are drained into a common receiver 123 and the product is filtered, with the filter cake being added to the char for purposes of determining yields. The filtrate is then stripped to remove solvent, if present, and water, to kettle temperature of 200° C. at atmospheric pressure. Any light oil which distilled off with the water is separated from the distillate by decantation and returned to the still. The tar is then distilled to recover four fractions: (1) a first fraction boing below 130° C at atmospheric pressure and a reflux ratio of 3 to 1; (2) a second fraction, or light oil, boing at 130° C. to 2660° C. at 50 mm. and a reflux ratio of 6 to 1; (3) a third fraction, or middle oil boiling at 260° C. to 340° C. at 10 mm. and a reflux ratio of 3 to 1; and (4) a residue consisting of pasting oil (boiling at 340° C. to 350° C. at 10 mm.) and pitch Tar fractions are analyzed by titration or gas chromatographic analysis for the presence of phenolic materials or tar acids.

The data for these experiments are summarized in tabular form below:

| Example | 4 | 5 | 6 | 7 | 8 | 9 | 10 | 11 | 12 |
|---|---|---|---|---|---|---|---|---|---|
| | Example Nos. 4–22 | | | | | | | | |
| Coal | | | | | | | | | |
| Ultimate Analysis[1] | | | | | | | | | |
| C | 72.2 | 72.5 | 72.6 | 72.3 | 73.2 | 70.6 | 73.2 | 73.0 | 71.0 |
| H | 5.2 | 5.5 | 5.1 | 5.2 | 5.5 | 5.1 | 5.5 | 5.3 | 5.1 |
| N | 1.0 | 1.4 | 1.6 | 1.7 | 2.0 | 1.4 | 1.3 | 1.0 | 2.1 |
| S | 0.8 | 1.0 | 1.0 | 1.2 | 1.2 | 1.0 | 0.8 | 0.9 | 1.0 |
| O | 20.8 | 19.6 | 19.7 | 19.6 | 18.1 | 21.9 | 19.2 | 19.8 | 20.8 |
| Ash[2] | 11.5 | 16.6 | 10.5 | 18.1 | 18.0 | 14.0 | 13.8 | 9.0 | 15.4 |
| Reaction Conditions | | | | | | | | | |
| Temperature, ° C. | 560 | 497 | 562 | 511 | 508 | 539 | 522 | 511 | 540 |
| Pressure | | | | | | | | | |
| Total, psig | 340 | 1000 | 650 | 1000 | 1000 | 500 | 1000 | 1000 | 1000 |
| Hydrogen, psi[3] | 300 | 940 | 600 | 920 | 910 | 450 | 860 | 956 | 890 |
| Solids residence time, minutes | 3.8 | 3.7 | 2.8 | 8.2 | 8.8 | 8.4 | 7.4 | 9.4 | 4.9 |
| Total time, hr. | 3.5 | 8.17 | 2.5 | 7.83 | 8.67 | 8.33 | 6.42 | 8.42 | 4.67 |
| $S_H$ | 564 | 572 | 581 | 583 | 585 | 590 | 591 | 592 | 596 |

| Example | 13 | 14 | 15 | 16 | 17 | 18 | 19 | 20 | 21 | 22 |
|---|---|---|---|---|---|---|---|---|---|---|
| Coal | | | | | | | | | | |
| Ultimate Analysis[1] | | | | | | | | | | |
| C | 71.5 | 71.4 | 71.0 | 73.5 | 71.0 | 70.9 | 70.8 | 73.5 | 72. | 72.1 |
| H | 5.3 | 5.0 | 5.0 | 5.2 | 5.1 | 5.2 | 5.2 | 5.3 | 5.3 | 5.2 |

-continued

| | Example Nos. 4–22 | | | | | | | | | |
|---|---|---|---|---|---|---|---|---|---|---|
| N | 1.1 | 1.8 | 1.7 | 1.9 | 1.3 | 1.4 | 1.4 | 1.0 | 1.4 | 1.3 |
| S | 0.8 | 1.0 | 1.0 | 1.2 | 1.2 | 1.1 | 1.1 | 0.9 | 1.0 | 1.0 |
| O | 21.3 | 20.8 | 21.3 | 18.2 | 21.4 | 21.4 | 21.5 | 19.3 | 20.3 | 20.4 |
| Ash(2) | 10.8 | 17.1 | 16.8 | 12.0 | 16.2 | 15.9 | 15.6 | 9.3 | 16.0 | 9.5 |
| Reaction Conditions | | | | | | | | | | |
| Temperature ° C. | 560 | 571 | 538 | 558 | 536 | 536 | 536 | 543 | 567 | 567 |
| Pressure | | | | | | | | | | |
| Total, psig | 340 | 1000 | 750 | 340 | 1000 | 1000 | 1000 | 1000 | 1000 | 1000 |
| Hydrogen, psi(3) | 310 | 830 | 667 | 320 | 890 | 895 | 900 | 945 | 875 | 936 |
| Solids residence time, minutes | 8.2 | 2.9 | 9.8 | 12.5 | 9.5 | 10 | 10.6 | 9.2 | 9.0 | 10.2 |
| Total time, hr. | 7.42 | 2.67 | 9.62 | 10.75 | 9.33 | 19.24 | 9.92 | 8.67 | 8.5 | 9.25 |
| $S_H$ | 597 | 606 | 610 | 611 | 620 | 621 | 623 | 627 | 650 | 661 |

| Results | 4 | 5 | 6 | 7 | 8 | 9 | 10 |
|---|---|---|---|---|---|---|---|
| Product Yields | | | | | | | |
| Wt. % MAF Coal | | | | | | | |
| Char | 58.2 | 49.5 | 54.2 | 44.0 | 44.6 | 48.4 | 35.8 |
| Tar | 15.3 | 23.4 | 17.0 | 27.6 | 25.4 | 19.5 | 28.0 |
| Gas | 12.0 | 13.0 | 11.9 | 18.5 | 19.9 | 16.5 | 19.9 |
| Water | 15.6 | 13.6 | 18.0 | 14.7 | 13.5 | 15.6 | 18.3 |
| Ultimate Analyses — MAF | | | | | | | |
| C | 87.3 | — | 89.0 | 89.2 | 89.1 | 94.0 | 92.0 |
| H | 3.7 | — | 3.8 | 4.5 | 4.3 | 4.3 | 4.5 |
| N | 1.4 | — | 1.3 | 1.3 | 1.3 | 1.7 | 1.2 |
| S | 1.0 | — | 1.0 | 1.3 | 1.1 | 1.1 | 0.7 |
| O | 6.6 | — | 4.9 | 3.7 | 4.2 | (−1.1) | 1.6 |
| Tar Acids, wt. % MAF Coal | | | | | | | |
| 0–260 C. | 4.5 | — | 4.7 | 5.8 | — | 4.4 | — |
| 260–340 C. | 0.9 | — | 1.5 | 1.6 | — | 1.1 | — |
| Total | 5.4 | — | 6.2 | 7.4 | — | 5.5 | — |
| Hydrogen consumed, wt. % MAF Coal | 1.1 | 1.9 | 1.2 | 2.1 | 2.2 | 1.9 | 2.2 |
| Tar/$H_2$ ratio | 13.9 | 12.3 | 14.2 | 13.1 | 11.5 | 10.3 | 12.7 |
| Tar Acid/$H_2$ ratio | 4.9 | — | 5.2 | 3.5 | — | 2.9 | — |

| Results | 11 | 12 | 13 | 14 | 15 | 16 |
|---|---|---|---|---|---|---|
| Product Yields | | | | | | |
| Wt. % MAF Coal | | | | | | |
| Char | 50.7 | 45.0 | 50.4 | 44.1 | 40.2 | 50.3 |
| Tar | 22.3 | 25.6 | 21.3 | 20.8 | 25.3 | 21.0 |
| Gas | 14.9 | 18.0 | 13.7 | 19.5 | 17.5 | 13.7 |
| Water | 12.8 | 15.3 | 16.0 | 16.7 | 16.7 | 16.5 |
| Ultimate Analyses — MAF | | | | | | |
| C | 90.2 | 90.1 | 91.2 | 91.8 | 90.5 | |
| H | 4.1 | 4.2 | 3.9 | 3.9 | 4.3 | 3.8 |
| N | 1.3 | 1.5 | 1.2 | 1.3 | 1.4 | 1.5 |
| S | 0.6 | 1.1 | 1.0 | 1.3 | 1.4 | 0.7 |
| O | 5.9 | 3.0 | 3.8 | 2.3 | 1.1 | 3.5 |
| Tar Acids, wt. % MAF Coal | | | | | | |
| 0–260 C | 5.0 | — | 5.1 | — | 4.4 | 5.5 |
| 260–340 C. | 1.7 | — | 1.5 | — | 1.9 | 1.5 |
| Total | 6.7 | — | 6.6 | — | 6.3 | 7.0 |
| Hydrogen consumed, Wt. % MAF Coal | 1.8 | 2.4 | 1.4 | 2.8 | 2.5 | 1.5 |
| Tar/$H_2$ ratio | 12.4 | 10.6 | 15.2 | 7.4 | 10.1 | 14.0 |
| Tar Acid/$H_2$ ratio | 3.7 | — | 4.7 | — | 2.5 | 4.7 |

| Results | 17 | 18 | 19 | 20 | 21 | 22 |
|---|---|---|---|---|---|---|
| Product Yields | | | | | | |
| Wt. % MAF Coal | | | | | | |
| Char | 39.6 | 38.5 | 37.5 | 39.8 | 33.3 | 38.4 |
| Tar | 27.8 | 28.4 | 29.1 | 27.3 | 27.3 | 29.0 |
| Gas | 22.5 | 21.8 | 21.0 | 17.9 | 21.7 | 19.2 |
| Water | 16.6 | 15.8 | 15.0 | 15.2 | 19.3 | 16.2 |
| Ultimate Analyses — MAF | | | | | | |
| C | 92.5 | 93.0 | 93.5 | 92.0 | 94.0 | 93.0 |
| H | 4.1 | 4.2 | 4.2 | 4.0 | 3.7 | 3.8 |
| N | 1.6 | 1.4 | 1.2 | 1.3 | 1.1 | 1.3 |
| S | 1.3 | 1.2 | 1.1 | 0.6 | 1.2 | 0.6 |
| O | 0.5 | 0.2 | 0.0 | 2.1 | 0.0 | 1.3 |
| Tar Acids, wt. % MAF Coal | | | | | | |
| 0–260 C. | — | 5.7 | — | 6.3 | — | 7.6 |
| 260–340 C. | — | 1.4 | — | 0.8 | — | 0.8 |
| Total | — | 7.1 | — | 7.1 | — | 8.4 |
| Hydrogen consumed, wt. % MAF Coal | 3.3 | 3.4 | 3.5 | 2.9 | 4.1 | 3.5 |
| Tar/$H_2$ ratio | 8.4 | 8.4 | 8.3 | 9.4 | 6.8 | 9.4 |

-continued

| | | Example Nos. 4–22 | | | | |
|---|---|---|---|---|---|---|
| Tar Acid/$H_2$ ratio | — | 2.1 | — | 2.4 | — | 2.4 |

(1)Moisture and ash free basis (MAF).
(2)Moisture free basis.
(3)partial pressure

EXAMPLES XXIII and XXXIV

Two additional runs are conducted employing apparatus and procedures similar to those employed in Examples IV–XXII except that the product gas is not recycled to the reactor. These additional runs are conducted to determine the effect of the carbon dioxide present in the recycle gas on hydrogen consumption. The data for these runs are summarized below.

| Example | 23 | 24 |
|---|---|---|
| Coal | | |
| Ultimate Analysis, MAF | | |
| C | 73.7 | 73.0 |
| H | 5.1 | 5.1 |
| N | 1.0 | 1.3 |
| S | 1.0 | 1.0 |
| O | 19.2 | 19.6 |
| Ash, moisture free | 8.5 | 8.5 |
| Reaction Conditions | | |
| Temperature, ° C. | 544 | 531 |
| Pressure | | |
| Total, psig. | 600 | 600 |
| Hydrogen, psi. (partial pressure) | 600 | 600 |
| Solids residence time, minutes | 13.2 | 14.8 |
| Total time hr. | 12.4 | 11.3 |
| $S_H$ | 624 | 615 |
| Results | | |
| Product Yields | | |
| Wt.% MAF coal | | |
| Char | 45.6 | 48.5 |
| Tar | 23.6 | 25.2 |
| Gas | 16.0 | 14.2 |
| Water | 16.8 | 13.7 |
| Char-Ultimate Analysis, MAF | | |
| C | 90.5 | 90.4 |
| H | 3.9 | 4.1 |
| N | 1.2 | 1.2 |
| S | 0.9 | 0.9 |
| O | 3.5 | 3.4 |
| Tar Acids, % MAF Coal | | |
| 0–260° C. | 6.3 | 6.1 |
| 260–340° C. | 1.3 | 1.5 |
| Total | 7.6 | 7.6 |
| Hydrogen consumed, % MFA Coal | 2.0 | 1.6 |
| Tar/$H_2$ ratio | 11.8 | 15.8 |
| Tar acid/$H_2$ ratio | 3.8 | 4.75 |

By comparison of the amounts of hydrogen consumed and tar and tar acids produced per unit hydrogen consumed in these examples with those runs employing recycle having similar severity factors ($S_H$) it can be seen that improved results are obtained when no gas recycle is employed. Thus, at a severity factor of 624 without recycle (Example 23) the amount of hydrogen consumed is only 2.0 percent of the coal, as compared with 2.9 to 3.5 for Examples 19 and 20. In addition, the ratios of tar and tar acids to hydrogen consumed is 11.8 and 3.8, respectively, in Example 23. In contrast, the tar to hydrogen ratios in Examples 19 and 20 is 8.3 to 9.4, and the tar acid to hydrogen ratio of Example 20 was only 2.4.

These improved results are due to the avoidance of the following reactions.

$$H_2 + CO_2 \rightarrow H_2O + CO$$

$$3H_2 + CO \rightarrow CH_4 + H_2O$$

because of the presence of carbon dioxide or monoxide in the system in significant amounts due to recycle.

EXAMPLE XXV

Employing techniques similar to those employed in the preceding examples, a pilot-plant run is made over about one week. The reactor in this run is 11 inches in diameter and 20 feet high. The hydrocarbonization temperature is 540° C., the hydrogen partial pressure is 397 psi and the solids residence time is 14.3 minutes, for a hydrocarbonization factor ($S_H$) of 606.

The product yields, based on MAF coal, are 53 percent char, 19 percent tar, 15.5 percent gas and 15.2 percent water at a hydrogen consumption of 1.74 percent based on MAF coal. Tar acids boiling below 230° C. amounted to 5.60 percent of MAF coal. Thus, the ratio of tar to hydrogen consumed is 10.9 and the ratio of tar acids boiling below 230° C. to hydrogen consumed is 3.22.

On recycle of tar boiling above 230° C., the yield of tar acis boiling below 230° C. is increased from 5.61 percent to 7.04 percent of MAF coal at a total hydrogen consumption of 1.93 percent of MAF coal, for a low temperature tar acid to hydrogen ratio of 3.65 as compared to 3.22 without recycle.

The data of this example, when compared with that of Example 15 also indicates the effect of simultaneous dealkylation of alkylphenols on product distribution. The vapor residence time in the small reactor of the previous examples is too short to permit the occurrence of significant dealkylation. In this example, however, the vapor residence time is 18.5 seconds, for a severity factor ($S_c$) of only 640, which is below the preferred range. Nevertheless, the proportion of tar acid boiling below 260° C. to all tar acid boiling below 340° C. increased from 70 percent in Example 15 to over 81 percent in this example.

The coal employed in several of the following experiments is generally known as Lake DeSmet coal. This coal is taken from an unusual formation in Northern Wyoming and exists in the form of lens of coal with thicknesses up to 200 feet. This deposit of coal lies near the surface of the ground, and in the time past has partially burned out forming a basin now filled with water. This is known as Lake De Smet. The coal employed was taken from the land next adjacent to the Southern border of the lake. The coal is of subbituminous C rank.

It has been found in one aspect of the present invention that even mild exposure of the low rank Lake de Smet coal to air oxidation results in a marked decrease in process yields of phenolic compounds. For example, drying the coal in a commercial vacuum oven at 50° C. and grinding and screening the dried coal in air reduced the tar yield by about 50 percent with a proportionate loss of phenolic compounds.

EXAMPLE XXVI

HYDROCARBONIZATION OF LAKE DE SMET COAL

In the hydrocarbonization of Lake de Smet coal, it is found that extreme care is necessary in order to prevent oxidation and obtain truly representative yields from this low-rank coal.

A sample of Lake de Smet coal is carefully protected for shipment by placing the wet cores in polyethylene bags and surrounding the bags as they were packed in a box with wet core cuttings. On arrival at the research laboratory, an aliquot sample of the cores is picked, partially dried at ambient temperature in a vacuum desiccator, ground and analyzed. The balance of the core samples is placed in a commercial vacuum drying oven and dried overnight at 50° C. The cores are then ground to yield sufficient 40–100 mesh coal for tow experimental runs. The hydrocarbonization unit and the operating procedure employed in this and in all succeeding experiments in this report are described in Examples 4–22.

The analysis of the aliquot sample and the sample prepared for experimental use are shown in Table V. The operating conditions and the product yields are shown in Table VI.

TABLE V

PROPERTIES OF LAKE DE SMET COAL

| Proximate Analysis | Aliquot Sample Weight Per Cent as Received | Experimental Sample |
|---|---|---|
| Volatile Matter | 33.8 | 38.2 |
| Fixed Carbon | 35.8 | 45.9 |
| Moisture | 19.3 | 1.5 |
| Ash | 11.1 | 14.4 |
| Ultimate Analysis, Weight Per Cent MAF | | |
| C | 72.4 | 72.2 |
| H | 5.3 | 4.3 |
| N | 1.6 | 1.5 |
| S | 1.6 | 1.7 |
| O (by difference) | 19.1 | 20.3 |

TABLE VI

CARBONIZATION AND HYDROCRABONIZATION OF LAKE DE SMET COAL

| | Operating Conditions | | |
|---|---|---|---|
| | Col. (1) Experimental Sample | Col. (2) Experimental Sample | Col. (3) Non-Oxidized Non-Air Dried Lake De Smet Coal |
| Fluidization Gas | Nitrogen | Hydrogen | Hydrogen |
| Pressure, psig | 200 | 400 | 500 |
| Temperature, ° C. | 515 | 515 | 539 |
| Hydrogen Partial Pressure, psi. | nil | 320 | 450 |
| | Yield, Weight Per Cent MAF Coal | | |
| Char | 76.6 | 68.9 | 48.4 |
| Tar | 5.9 | 8.9 | 19.5 |
| Gas | 9.0 | 11.6 | 16.5 |
| Water | 8.5 | 11.5 | 15.6 |
| Hydrogen | — | —0.9 | —1.9 |
| | 100.0 | 100.0 | 100.0 |

DISCUSSION OF RESULTS

The yield of tar from the experimental supply of lake de Smet coal is only 5.9 percent MAF coal when carbonized in an inert atmosphere as shown in Column (1), Table VI. The char yield is 76.6 percent Furthermore, Column (2) shows that in a hydrogen atmosphere, at a hydrogen partial pressure of 320 psi., the tar yield increases to only 8.9 percent Interpolation of data shown in column (3) obtained from unoxidized coal in succeeding runs at the same operating conditions, shows that the tar yield should be about 17.0 percent and 57.07% char. The char yield is 68.9. Turning to the ultimate analyses given in Table V, it is apparent that the experimental supply of coal lost hydrogen, down from 5.3 to 4.3 percent and gained oxygen, up from 19.9 to 20.3 percent during the drying and grinding operations. The adverse effect of oxidation on the tar yields from these experiments shows that extreme care is required in handling the coal in order to obtain maximum yields of phenolics.

EXAMPLE XXVII

DRYING IN THE PRESENCE OF OXYGEN

Combustion processes to produce hot flue gases usually are run with an excess of oxygen (air) to ensure complete combustion of the fuel. In the tentative design for a commercial hydrocarbonization plant, hot flue gas containing 2 percent free oxygen is used to dry and preheat the pulverized coal. Two separate fluidized vessels are used, a dryer operating at 100° C. and preheater operating at 285° C. A study is made to define the effect of using a flue gas containing 2 percent oxygen in drying and preheating coal upon the tar yield during subsequent hydrocarbonization. The method chosen to evaluate the tar yield of the treated coal is the Fischer Assay test. (U.S. Bureau of Mines Bulletin 530, 1953, "Low Temperature Carbonization Assay of Coal in a Precision Laboratory Apparatus," by Goodman, J. B., Gomez, M., Parry, V. F., and Landers, W. S.).

1. Preparation of Samples

The Lake De Smet coal in this example is taken from a 55-gallon drum in which the coal has been covered with water from the time it had been shipped. The wet lump coal is surface dried, pulverized, screened to obtain a 40–100-mesh fraction, and stored under positive pressure nitrogen until ready for use. A moisture determination of 29.5 percent shows that this coal has been little more than surface dried during preparation, since the moisture content of coal as mined is approximately 30 percent. A 3-quart sample of this prepared coal is put in a 1-gallon metal sample can, flushed with nitrogen, and the lid soldered on. This sample (No. 1) is used to establish the base yield of tar by the Fischer Assay. The other samples, Nos. 2, 3, and 4 are prepared in the aforementioned hydrocarbonization unit previously described in Examples IV–XXII. The pertinent operating conditions used to prepare Samples 2, 3, and 4 are as follows:

NOTES

Sample

1. Raw Lake de Smet Coal; sample contains 29.6 percent moisture (xylol method) and 6.1 percent ash.

2. Dried Lake De Smet coal; sample dried at 100° C; fluidization gas: nitrogen. Sample contains 5.8 percent moisture (xylol) and 8.2 percent ash.

3. Dried Lake de Smet coal; sample dried at 100° C; fluidization gas: 2 percent oxygen and 98 percent nitrogen. sample contains 4.4 percent moisture (xylol) and 8.8 percent ash.

4. Dried Lake de Smet coal sample dried at 285° C.; fluidization gas: 2 percent oxygen and 98 percent nitrogen. Sample contains 1.1 percent moisture (xylol) and 8.6 percent ash.

EXAMPLE XXVIII

Hydrocarbonization yields are determined for samples of Wyodak coal (a subbituminous C coal from a strip mine near Gillette, Wyoming.) and Texas and North Dakota lignites. The results are compared to the results obtained from Lake de Smet coal at similar operating conditions.

The experimental apparatus and the operating procedure are the same as used in Examples IV–XXII and additionally, air oxidation of the coal and lignite is also avoided.

Experiments are made to determine the hydrocarbonization yields from Wyodak coal and Texas and North Dakota lignites at 1000 psig, 510°–535° C. and a residence time of 8 to 10 minutes. For comparison, the hydrocarbonization yields for Lae de Smet Coal, at similar operating conditions, are presented.

The analyses of the feed coals and lignites and the hydrocarbonized chars are given in Table VIII. The operating conditions, yields and hydrogen consumption are given in Table IV. Table X gives the gas yields and composition. The physical properties of the tars are given in Table XI.

| | Samples | | |
|---|---|---|---|
| | 2 | 3 | 4 |
| Drying Temperature, ° C. | 100 | 100 | 285 |
| Coal Feed Rate, g/Hr. | 250 | 250 | 580 |
| Residence Time, min. | 15 | 15 | 7 |
| Fluidization Gas | High Purity Nitrogen | 98% Nitrogen 2% Oxygen | 98% Nitrogen 2% Oxygen |
| Gas Flow, SCFH | 5.6 | 5.6 | 5.6 |
| Weight Percent Oxygen Relative to Coal | 0 | 1.7 | 0.7 |

The coal receiver is allowed to cool to room temperature under a positive pressure of high purity nitrogen. The cold samples are then assayed by the Fischer Assay test.

FISCHER ASSAY RESULTS

The complete assay results are given in Table VII. The pertinent assay results are summarized as follows:

| | Sample Numbers | | | |
|---|---|---|---|---|
| | 1 | 2 | 3 | 4 |
| Char Yield, % MAF | 67.6 | 66.3 | 66.4 | 67.8 |
| Tar and Light Oil, % MAF | 10.4 | 10.3 | 9.6 | 8.8 |
| % Loss in Tar Yield | — | 1.0 | 7.7 | 15.4 |

The results of this study show that the Lake de Smet coal is sensitive to as little as 2 percent oxygen in the gas used for drying and preheating the coal.

TABLE VII

PRECISION LABORATORY CARBONIZATION ASSAYS AND ANALYSES
UNION CARBIDE LAKE DE SMET COAL SAMPLES

| Sample | 1 | 1 | 2 | 2 | 3 | 3 | 4 | 4 |
|---|---|---|---|---|---|---|---|---|
| Temp. of Carbonization, ° C. | 500 | 500 | 500 | 500 | 500 | 500 | 500 | 500 |
| Carbonization Yields, MAF % | | | | | | | | |
| Char | 67.6 | 67.5 | 66.3 | 66.2 | 66.4 | 66.4 | 67.7 | 67.9 |
| Water formed | 10.3 | 10.4 | 11.6 | 11.6 | 12.0 | 12.1 | 11.2 | 11.1 |
| Tar, Dry | 9.3 | 9.3 | 9.3 | 9.2 | 8.8 | 8.5 | 7.7 | 8.0 |
| Light Oil | 1.1 | 1.1 | 1.1 | 0.9 | 0.9 | 0.9 | 1.0 | 0.9 |
| Gas | 11.5 | 11.5 | 11.4 | 12.1 | 11.6 | 11.8 | 12.0 | 11.8 |
| Hydrogen Sulfide | 0.3 | 0.3 | 0.2 | 0.2 | 0.3 | 0.3 | 0.3 | 0.3 |
| Total | 100.1 | 100.1 | 99.9 | 100.2 | 100.0 | 100.0 | 99.9 | 100.0 |

TABLE VIII

ANALYSES OF FEED COAL AND LIGNITES AND HYDROCARBONIZED CHAR

| Coal or Lignite | Lake de Smet | Texas Lignite | North Dakota Lignite | Wyodak Coal |
|---|---|---|---|---|
| Ultimate Analysis, Weight Per Cent MAF | | | | |
| Feed | | | | |
| Element | | | | |
| C | 72.3 | 74.8 | 72.0 | 73.8 |
| H | 5.2 | 5.7 | 5.0 | 5.3 |
| N | 1.7 | 1.6 | 1.0 | 1.0 |
| S | 1.2 | 1.6 | 1.1 | 0.6 |
| 0(by difference) | 19.6 | 16.3 | 20.9 | 19.3 |
| % Ash, dry basis | 18.1 | 11.6 | 7.6 | 5.8 |
| Hydrocarbonized Char | | | | |
| C | 89.2 | 87.5 | 88.6 | 89.0 |
| H | 4.5 | 4.2 | 4.1 | 4.0 |
| N | 1.3 | 2.0 | 1.3 | 1.3 |
| S | 1.3 | 1.6 | 0.8 | 0.6 |
| 0(by difference) | 3.7 | 4.7 | 5.2 | 5.1 |

TABLE IX

HYDROCARBONIZATION OF LIGNITES AND WYODAK COAL
OPERATING CONDITIONS AND YIELDS

| Coal or | Operating Conditions | | | |
|---|---|---|---|---|
| | Lake De Smet | Texas | N.D. Lignite | Wyodak |

TABLE IX-continued

| HYDROCARBONIZATION OF LIGNITES AND WYODAK COAL OPERATING CONDITIONS AND YIELDS | | | | |
|---|---|---|---|---|
| Lignite | Lignite | | | |
| Hydro-carbonization Temperature, ° C. | 511 | 512 | 510 | 535 |
| System Pressure, psig | 1000 | 1000 | 1000 | 1000 |
| Fluidization Gas | Hydrogen | Hydrogen | Hydrogen | Hydrogen |
| Avg. $H_2$ Partial Pressure, psi. | 920 | 890 | 900 | 920 |
| Residence Time (defined time required to fill the carbonizer with fresh feed at 30 lbs/ft³ fluidized density), minutes | 8.2 | 8.1 | 9.8 | 9.8 |
| Length of Run, hrs. | 7.83 | 6.58 | 7.92 | 8.42 |
| Yields, Weight Per Cent MAF Feed | | | | |
| Char | 44.0 | 43.0* | 48.3 | 48.1 |
| Tar | 27.6 | 31.2 | 27.0 | 26.9 |
| Gas | 18.5 | 18.7 | 14.7 | 15.3** |
| Water | 14.7 | 9.6 | 15.1 | 11.7 |
| Hydrogen | −2.1 | −2.5 | −2.3 | −2.0 |
| Unaccounted for | −2.7 | 0.0 | −2.8 | 0.0 |
| | 100.0 | 100.0 | 100.0 | 100.0 |

*An unknown amount of feed was left in hopper, yields are normalized to 100%
**Gas by difference

TABLE X

| HYDROCARBONIZATION OF LIGNITES AND WYODAK COAL GAS YIELDS AND COMPOSITION | | | | |
|---|---|---|---|---|
| Coal or Lignite | Lake de Smet | Texas Lignite | N. D. Lignite | Wyodak |
| Gas Yields | | | | |
| Weight Gas, Lb./Ton MAF | 370 | 374 | 294 | 306 |
| Volume Gas, SCF/Ton MAF | 5300 | 5820 | 4570 | 4830 |
| Gas Composition, Volume Per Cent | | | | |
| Component | | | | |
| Methane | 35.7 | 45.6 | 44.0 | 48.9 |
| Ethane | 11.4 | 12.7 | 11.6 | 11.3 |
| Propane | 2.1 | 3.7 | 3.6 | 7.6 |
| Carbon Monoxide | 29.0 | 28.3 | 32.0 | 26.5 |
| Carbon Dioxide | 21.8 | 9.7 | 8.8 | 5.7 |
| Molecular Weight of make Gas | 27.7 | 24.9 | 24.9 | 24.5 |

TABLE XI

| HYDROCARBONIZATION OF LIGNITES AND WYODAK COAL SOME PHYSICAL PROPERTIES OF THE TAR | | | | |
|---|---|---|---|---|
| Coal or Lignite | Lake de Smet | Texas Lignite | N.D. Lignite | Wyodak |
| Cyclohexane Insoluble Asphalt | | | | |
| Per Cent Tar | 21.0 | 21.7 | 26.8 | 17.6 |
| Per Cent MAF Coal | 5.8 | 6.8 | 7.2 | 4.6 |
| Tar Distillation, Weight Per Cent | | | | |
| Boiling Range, ° C. | | | | |
| IBP – 110 | 9.3* | 1.8** | 3.5** | |
| 110 – 260 | 29.8 | 21.5 | 29.2 | |
| 260 – 320 | 10.9 | — | — | |
| 260 – 340 | — | 17.8 | 16.0 | |
| Residue | 50.0 | 55.8 | 51.3 | |
| Oil Yields, Per Cent MAF Coal | | | | |
| IBP – 110 | 2.6 | 0.6 | 1.0 | |
| 110 – 260 | 8.2 | 6.7 | 7.9 | |
| 260 – 320 | 3.0 | — | — | |
| 260 – 340 | — | 5.6 | 4.3 | |
| Total IBP – 320 | 13.8 | — | — | |
| Total IBP – 340 | — | 12.9 | 13.2 | |
| Phenols and Neutral Oil Yields, % MAF Coal (By Extraction) | | | | |
| Boiling Range, ° C. | | | | |
| 110 – 260 | | | | |

TABLE XI-continued

| HYDROCARBONIZATION OF LIGNITES AND WYODAK COAL SOME PHYSICAL PROPERTIES OF THE TAR | | | | |
|---|---|---|---|---|
| Coal or Lignite | Lake de Smet | Texas Lignite | N.D. Lignite | Wyodak |
| Phenols | 5.8 | 3.5 | 5.7 | |
| Neutral Oil | 2.5 | 3.2 | 2.2 | |
| 260 – 320 | | | | |
| Phenols | 1.6 | — | — | |
| Neutral Oil | 1.5 | — | — | |
| 260 – 340 | | | | |
| Phenols | — | 2.4 | 2.5 | |
| Neutral Oil | — | 3.2 | 1.9 | |
| Total Phenols, 110 – 320 | 7.4 | — | — | |
| Total Phenols 110 – 340 | — | 5.9 | 8.2 | |

*Distillation in a packed column with reflux
**Vigreaux distillation on lignite tars.

The hydrocarbonization of a sample of Texas lignite in a hydrogen atmosphere at 1000 psig and 510° C. gave a yield of 625 pounds of tar per ton of moisture and ash free lignite. This may be compared to a tar yield of 550 pounds per ton when Lake de Smet coal is hydrocarbonized at the same operating conditions. A North Dakota lignite and Wyodak coal gave about the same tar yield as the Lake de Smet coal.

The light oil phenol yield is 115 pounds per ton of MAF feed for the North Dakota lignite and the Lake de Smet coal. The light oil phenol yield for the Texas lignite is 70 pounds per ton of MAF lignite.

What is claimed is:

1. A process for the hydrocarbonization of coal particles employing a fluid-bed zone of hydrocarbonization comprising:

a. fluidizing coal particles with a non-oxidizing gas to form a dense phase;

b. pressurizing said particles with a hydrogen-rich gas;

c. preheating said coal particles in said dense phase in an essentially oxygen-free environment to a predetermined temperature below a temperature at which said coal particles undergo plastic transformation;

d. providing a fluid-bed within a hydrocarbonization zone at a reaction temperature of between about 480° C and about 600° C, said fluid-bed consisting essentially of a matrix of non-agglomerating coal and char particles at said reaction temperature fluidized by a hydrogenrich, oxygen-free gas;

e. continuously introducing said preheating coal particles and a hydrogen-rich, oxygen-free conveying gas into the lower portion of said zone in an essentially vertically upwards direction, said coal particles having a velocity sufficient to rapidly and uniformly disperse at said predetermined temperature, within said matrix, said velocity being greater than about 200 feet per second;

f. continuously reacting said coal particles in said zone with hydrogen in said zone at said reaction temperature to produce a product comprising a condensable vapor and solid char;

g. maintaining the solids in said zone for an average residence time of about 5 to about 60 minutes and said vapor for about 10 to about 250 seconds;

h. maintaining the average hydrogen partial pressure in said zone at about 100 p.s.i. to about 1200 p.s.i.; and i. continuously withdrawing from said zone said product vapor and solids.

2. A process as defined in claim 1 wherein in step *e*, said coal particles and said conveying gas are introduced through the substantially axially central portion of the bottom of said zone.

3. A process as defined in claim 2 wherein said coal particles and said conveying gas are introduced into the lower portion of said zone through at least one inlet having a constricted cross-sectional area designed to accelerate said coal particles and said conveying gas to said velocity.

4. A process as defined in claim 3 wherein said coal particles and said conveying gas are introduced into said lower portion of said zone through a multiplicity of inlets.

5. A process as defined in claim 3 wherein the surface of said inlet through which said coal particles flow comprises a wear-resistant material.

6. A process as defined in claim 5 wherein said wear-resistant material is tungsten carbide.

7. A process as defined in claim 1 wherein in step *g*, said average solids residence time is about 8 to about 30 minutes.

8. A process as defined in claim 1 wherein in step *d*, said non-agglomerating particles comprise partially reacted coal and char particles, and in step *h*, said hydrogen partial pressure in said zone is between about 200 p.s.i. and about 800 p.s.i.

9. A process as defined in claim 1 wherein said coal particles of step a comprise non-agglomeration subbituminous or lignitic coals.

10. A process as defined in claim 9 wherein said coal particles have at no time been exposed to oxidizing conditions prior to hydrocarbonization.

11. A process as defined in claim 1 wherein said coal particles are finer than about 8 Tyler mesh.

12. A process as defined in claim 1 wherein said coal particles of step a comprise agglomerating bituminous coals.

13. A process as defined in claim 1 wherein said coal particles velocity is greater than about 400 feet per second.

14. A process as defined in claim 1 further including in step e introducing a stream of recycle oil into the lower portion of said zone in an essentially vertically upwards direction at a velocity greater than about 200 feet per second.

15. A process as defined in claim 14 wherein said recycle oil velocity is greater than about 400 feet per second.

16. A process as defined in claim 1 wherein said predetermined preheat temperature is between about 200° C and about 375° C.

17. A process as defined in claim 16 wherein said predetermined preheat temperature is between about 325° C and about 375° C.

18. A process as defined in claim 1 further including after step *i*, j. lowering the temperature of said solid char product to a temperature between about 300° C and about 375° C.

19. A process as defined in claim 1 wherein the reaction temperature, hydrogen partial pressure and solids residence time conform to the equation:

$$S_H = T(P)^{0.067}\,(t)^{0.067}$$

wherein $S_H$ is a hydrocarbonization severity factor having a value of from 550 to 700; T is the hydrocarbonization temperature in ° C; P is the log mean average hydrogen partial pressure in said hydrocarbonization zone in psi divided by 1000; and t is the solids residence time in minutes.

20. A process as defined in claim 19 where in order to maximize total liquid product and minimize hydrogen consumption, the temperature and vapor residence time conform to the equation:

$$S_c = T(\theta)^{0.048}$$

wherein $S_c$ is a vapor cracking severity factor having a value of from 600 to 690; T is the temperature is ° C; and $\theta$ is the average vapor residence time in seconds.

* * * * *

UNITED STATES PATENT OFFICE

CERTIFICATE OF CORRECTION

Patent No. 3,988,236 Dated October 26, 1976

Inventor(s) Charles W. Albright et al.

It is certified that error appears in the above-identified patent and that said Letters Patent are hereby corrected as shown below:

Column 3, line 9, "lust" should read -- just --.

Column 33, line 7, claim 1, step (e), first line, "preheating" should read -- preheated --.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*